US011483661B2

(12) United States Patent
Qi et al.

(10) Patent No.: US 11,483,661 B2
(45) **Date of Patent: *Oct. 25, 2022**

(54) BONE CONDUCTION SPEAKER AND COMPOUND VIBRATION DEVICE THEREOF

(71) Applicant: SHENZHEN SHOKZ CO., LTD., Guangdong (CN)

(72) Inventors: Xin Qi, Shenzhen (CN); Fengyun Liao, Shenzhen (CN); Jinbo Zheng, Shenzhen (CN); Qian Chen, Shenzhen (CN); Hao Chen, Shenzhen (CN); Lei Zhang, Shenzhen (CN); Junjiang Fu, Shenzhen (CN); Bingyan Yan, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/218,745

(22) Filed: Mar. 31, 2021

(65) Prior Publication Data

US 2021/0250699 A1 Aug. 12, 2021

Related U.S. Application Data

(63) Continuation-in-part of application No. 17/170,817, filed on Feb. 8, 2021, now Pat. No. 11,395,072, which (Continued)

(30) Foreign Application Priority Data

Dec. 23, 2011 (CN) ..... 201110438083.9
Apr. 30, 2019 (CN) ..... 201910364346.2

(Continued)

(51) Int. Cl.
*H04R 1/10* (2006.01)
*H04R 25/00* (2006.01)

(Continued)

(52) U.S. Cl.
CPC ..... *H04R 9/063* (2013.01); *H04R 1/00* (2013.01); *H04R 1/10* (2013.01); *H04R 9/02* (2013.01);

(Continued)

(58) Field of Classification Search
CPC ... H04R 1/00; H04R 1/02; H04R 1/10; H04R 9/02; H04R 9/025; H04R 9/063;

(Continued)

(56) References Cited

U.S. PATENT DOCUMENTS 2,075,196 A 3/1937 Hand
4,418,248 A 11/1983 Mathis (Continued)

FOREIGN PATENT DOCUMENTS

CN 1842019 A * 10/2006 ..... H04R 1/02
CN 1976541 A 6/2007

(Continued)

OTHER PUBLICATIONS

First Office Action in Chinese Application No. 201110438083.9 dated Sep. 27, 2012, 10 pages.

(Continued)

*Primary Examiner* — Thang V Tran
(74) *Attorney, Agent, or Firm* — Metis IP LLC

(57) ABSTRACT

The present disclosure relates to a bone conduction speaker and its compound vibration device. The compound vibration device comprises a vibration conductive plate and a vibration board, the vibration conductive plate is set to be the first torus, where at least two first rods inside it converge to its center; the vibration board is set as the second torus, where (Continued)

at least two second rods inside it converge to its center. The vibration conductive plate is fixed with the vibration board; the first torus is fixed on a magnetic system, and the second torus comprises a fixed voice coil, which is driven by the magnetic system. The bone conduction speaker in the present disclosure and its compound vibration device adopt the fixed vibration conductive plate and vibration board, making the technique simpler with a lower cost; because the two adjustable parts in the compound vibration device can adjust both low frequency and high frequency area, the frequency response obtained is flatter and the sound is broader.

20 Claims, 19 Drawing Sheets

Related U.S. Application Data is a continuation of application No. 17/161,717, filed on Jan. 29, 2021, now Pat. No. 11,399,234, application No. 17/218,745, which is a continuation-in-part of application No. 17/129,733, filed on Dec. 21, 2020, which is a continuation of application No. PCT/CN2020/088482, filed on Apr. 30, 2020, said application No. 17/161,717 is a continuation-in-part of application No. 16/833,839, filed on Mar. 30, 2020, now Pat. No. 11,399,245, and a continuation-in-part of application No. 16/159,070, filed on Oct. 12, 2018, now Pat. No. 10,911,876, said application No. 16/833,839 is a continuation of application No. 15/752,452, filed as application No. PCT/CN2015/086907 on Aug. 13, 2015, now Pat. No. 10,609,496, said application No. 16/159,070 is a continuation of application No. 15/197,050, filed on Jun. 29, 2016, now Pat. No. 10,117,026, which is a continuation of application No. 14/513,371, filed on Oct. 14, 2014, now Pat. No. 9,402,116, which is a continuation of application No. 13/719,754, filed on Dec. 19, 2012, now Pat. No. 8,891,792.

(30) Foreign Application Priority Data

Sep. 19, 2019 (CN) ..... 201910888067.6
Sep. 19, 2019 (CN) ..... 201910888762.2

(51) Int. Cl.
*H04R 9/06* (2006.01)
*H04R 1/00* (2006.01)
*H04R 9/02* (2006.01)
*H04R 31/00* (2006.01)

(52) U.S. Cl.
CPC ..... *H04R 9/025* (2013.01); *H04R 9/066* (2013.01); *H04R 31/00* (2013.01); *H04R 25/606* (2013.01); *H04R 2460/13* (2013.01)

(58) Field of Classification Search
CPC ..... H04R 9/066; H04R 9/18; H04R 17/00; H04R 17/10; H04R 19/00; H04R 19/013; H04R 19/02; H04R 25/60; H04R 25/604; H04R 25/606; H04R 31/00; H04R 2460/13
See application file for complete search history.

(56) References Cited

U.S. PATENT DOCUMENTS

| | | | | |
|---|---|---|---|---|
| 5,673,328 | A | 9/1997 | Wandl et al. | |
| 5,734,132 | A | 3/1998 | Proni | |
| 5,790,684 | A | 8/1998 | Niino et al. | |
| 6,389,148 | B1 | 5/2002 | Yoo et al. | |
| 6,850,138 | B1 | 2/2005 | Sakai | |
| 8,891,792 | B2 * | 11/2014 | Qi | H04R 9/063 381/151 |
| 9,226,075 | B2 | 12/2015 | Lee | |
| 9,253,563 | B2 | 2/2016 | Fukuda | |
| 9,742,887 | B2 * | 8/2017 | Hosoi | G06F 1/1698 |
| 2003/0012395 | A1 | 1/2003 | Fukuda | |
| 2003/0053651 | A1 | 3/2003 | Koura et al. | |
| 2004/0105566 | A1 | 6/2004 | Matsunaga et al. | |
| 2004/0131218 | A1 | 7/2004 | Dedieu et al. | |
| 2006/0098829 | A1 | 5/2006 | Kobayashi | |
| 2006/0165246 | A1 | 7/2006 | Lee et al. | |
| 2006/0262954 | A1 | 11/2006 | Lee et al. | |
| 2007/0053536 | A1 | 3/2007 | Westerkull | |
| 2008/0166007 | A1 | 7/2008 | Hankey et al. | |
| 2009/0209806 | A1 | 8/2009 | Hakansson | |
| 2009/0245553 | A1 | 10/2009 | Parker | |
| 2009/0285417 | A1 | 11/2009 | Shin et al. | |
| 2010/0046783 | A1 | 2/2010 | Huang | |
| 2010/0246864 | A1 | 9/2010 | Hildebrandt et al. | |
| 2010/0329485 | A1 | 12/2010 | Fukuda | |
| 2012/0020501 | A1 | 1/2012 | Lee | |
| 2012/0083860 | A1 | 4/2012 | Hakansson | |
| 2012/0281861 | A1 | 11/2012 | Lin | |
| 2012/0286765 | A1 | 11/2012 | Heuvel et al. | |
| 2012/0302822 | A1 | 11/2012 | Van Himbeeck et al. | |
| 2013/0121513 | A1 | 5/2013 | Adachi | |
| 2013/0163791 | A1 | 6/2013 | Qi et al. | |
| 2013/0266170 | A1 | 10/2013 | Yamagishi | |
| 2013/0308798 | A1 | 11/2013 | Lee | |
| 2014/0064533 | A1 | 3/2014 | Kasic, II | |
| 2014/0226843 | A1 | 8/2014 | Pan | |
| 2014/0270293 | A1 | 9/2014 | Ruppersberg et al. | |
| 2015/0208183 | A1 | 7/2015 | Bern | |
| 2015/0264473 | A1 | 9/2015 | Fukuda | |
| 2016/0037243 | A1 | 2/2016 | Lippert et al. | |
| 2016/0127841 | A1 | 5/2016 | Horii | |
| 2017/0180878 | A1 | 6/2017 | Petersen et al. | |
| 2017/0374479 | A1 | 12/2017 | Qi et al. | |
| 2018/0295449 | A1 | 10/2018 | Morgan et al. | |
| 2019/0014425 | A1 | 1/2019 | Liao et al. | |
| 2019/0052954 | A1 | 2/2019 | Rusconi Clerici Beltrami et al. | |
| 2019/0238971 | A1 | 8/2019 | Wakeland et al. | |
| 2020/0112783 | A1 | 4/2020 | Wakeland et al. | |
| 2021/0014595 | A1 | 1/2021 | Li et al. | |

FOREIGN PATENT DOCUMENTS

| | | | |
|---|---|---|---|
| CN | 202435598 | U | 9/2012 |
| CN | 105007551 | A | 10/2015 |
| CN | 105101019 | A | 11/2015 |
| CN | 105101020 | A | 11/2015 |
| CN | 105142077 | A | 12/2015 |
| CN | 204887455 | U | 12/2015 |
| CN | 204948313 | U | 1/2016 |
| CN | 204948328 | U | 1/2016 |
| CN | 204948329 | U | 1/2016 |
| CN | 205142506 | U | 4/2016 |
| CN | 205336486 | U | 6/2016 |
| CN | 205754812 | U | 11/2016 |
| CN | 206865707 | U | 1/2018 |
| CN | 207070281 | U | 3/2018 |
| EP | 1404146 | A1 | 3/2004 |
| EP | 2234413 | B1 | 11/2020 |
| JP | S5574290 | A | 6/1980 |
| JP | 07007797 | A | 1/1995 |
| JP | 2003264882 | A | 9/2003 |
| JP | 2004064457 | A1 | 2/2004 |
| JP | 2004158961 | A | 6/2004 |
| JP | 2006025333 | A | 1/2006 |
| JP | 2007129384 | A | 5/2007 |
| JP | 2008017398 | A | 1/2008 |
| JP | 2008054063 | A | 3/2008 |
| JP | 2011160175 | A | 8/2011 |
| JP | 2013243564 | A | 12/2013 |
| KR | 20010111653 | A | 12/2001 |
| KR | 20050030183 | A | 3/2005 |

(56) References Cited

FOREIGN PATENT DOCUMENTS

| | | | |
|---|---|---|---|
| KR | 20070122104 | A | 12/2007 |
| KR | 20080101166 | A | 11/2008 |
| KR | 20080103334 | A | 11/2008 |
| KR | 20090082999 | A | 8/2009 |
| KR | 20090091378 | A | 8/2009 |
| KR | 200476572 | Y1 | 3/2015 |
| WO | 0219759 | A1 | 3/2002 |
| WO | 02078393 | A2 | 10/2002 |
| WO | 2006088410 | A1 | 8/2006 |
| WO | 2010114195 | A1 | 10/2010 |

OTHER PUBLICATIONS

The Extended European Search Report in European Application No. 12860348.7 dated Apr. 28, 2015, 7 pages.
International Search Report in PCT/CN2012/086513 dated Mar. 14, 2013, 5 pages.
Written Opinion in PCT/CN2012/086513 dated Mar. 14, 2013, 10 pages.
International Search Report in PCT/CN2020/088482 dated Aug. 5, 2020, 4 pages.
Written Opinion in PCT/CN2020/088482 dated Aug. 5, 2020, 4 pages.
Decision to Grant a Patent in Japanese Application No. 2018-146021 dated Jul. 21, 2020, 5 pages.
Notice of Preliminary Rejection in Republic of Korea Application No. 10-2018-7007115 dated May 20, 2021, 9 pages.
International Search Report in PCT/CN2015/086907 dated May 6, 2016, 10 pages.
Written Opinion in PCT/CN2015/086907 dated May 6, 2016, 12 pages.
Communication Pursuant to Article 94(3) EPC in European Application No. 15900793.9 dated Apr. 10, 2019, 6 pages.
Communication Pursuant to Article 94(3) EPC in European Application No. 15900793.9 dated Apr. 28, 2020, 9 pages.
Notice of Reasons for Rejection in Japanese Application No. 2018-506985 dated Sep. 3, 2019, 8 pages.
Notice of Reasons for Rejection in Japanese Application No. 2018-146019 dated Jul. 23, 2019, 8 pages.
Decision of Final Rejection in Japanese Application No. 2018-146019 dated Jan. 21, 2020, 9 pages.
Notice of Reasons for Rejection in Japanese Application No. 2018-146020 dated Jul. 23, 2019, 8 pages.
Notice of Reasons for Rejection in Japanese Application No. 2018-146021 dated Jul. 30, 2019, 8 pages.
M. Gripper et al., Using the Callsign Acquisition Test (CAT) to Compare the Speech Intelligibility of Air Versus Bone Conduction, International Journal of Industrial Ergonomics, 37(7): 631-641, 2007.
Martin L. Lenhardt et al., Measurement of Bone Conduction Levels for High Frequencies, International Tinnitus Journal, 8(1): 9-12, 2002.
The Extended European Search Report in European Application No. 21186537.3 dated Nov. 9, 2021, 9 pages.
Notice of Reasons for Rejection in Japanese Application No. 2020-088413 dated Aug. 3, 2021, 8 pages.
Notice of Preliminary Rejection in Korean Application No. 10-2022-7003237 dated Apr. 13, 2022, 14 pages.
Notice of Reasons for Rejection in Japanese Application No. 2020-088413 dated Sep. 6, 2022, 11 pages.

* cited by examiner

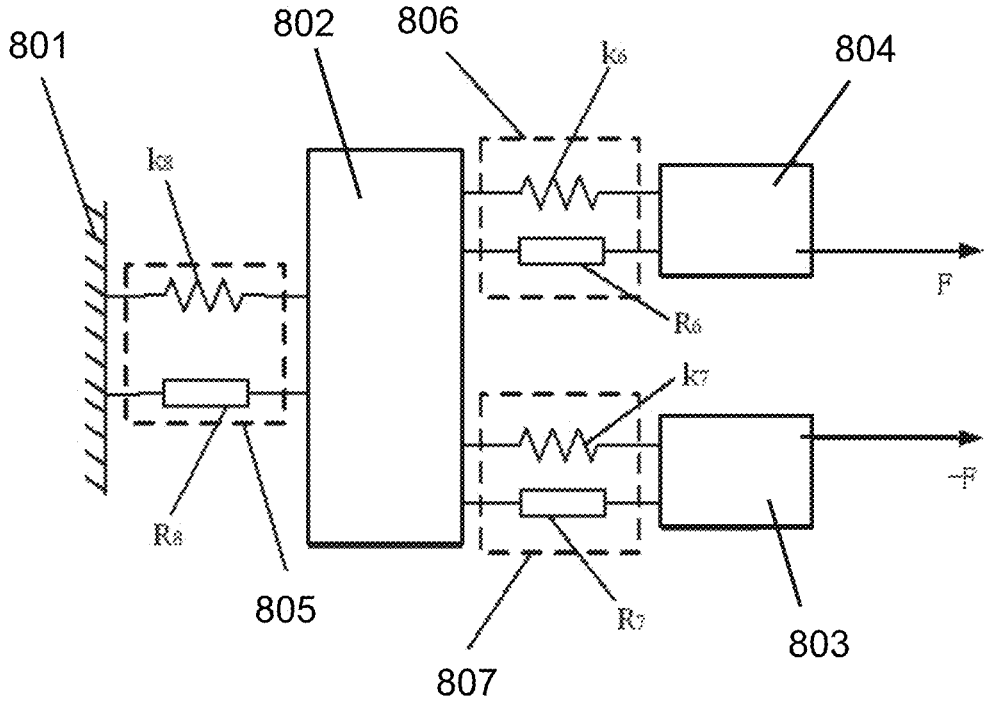
FIG. 8-A

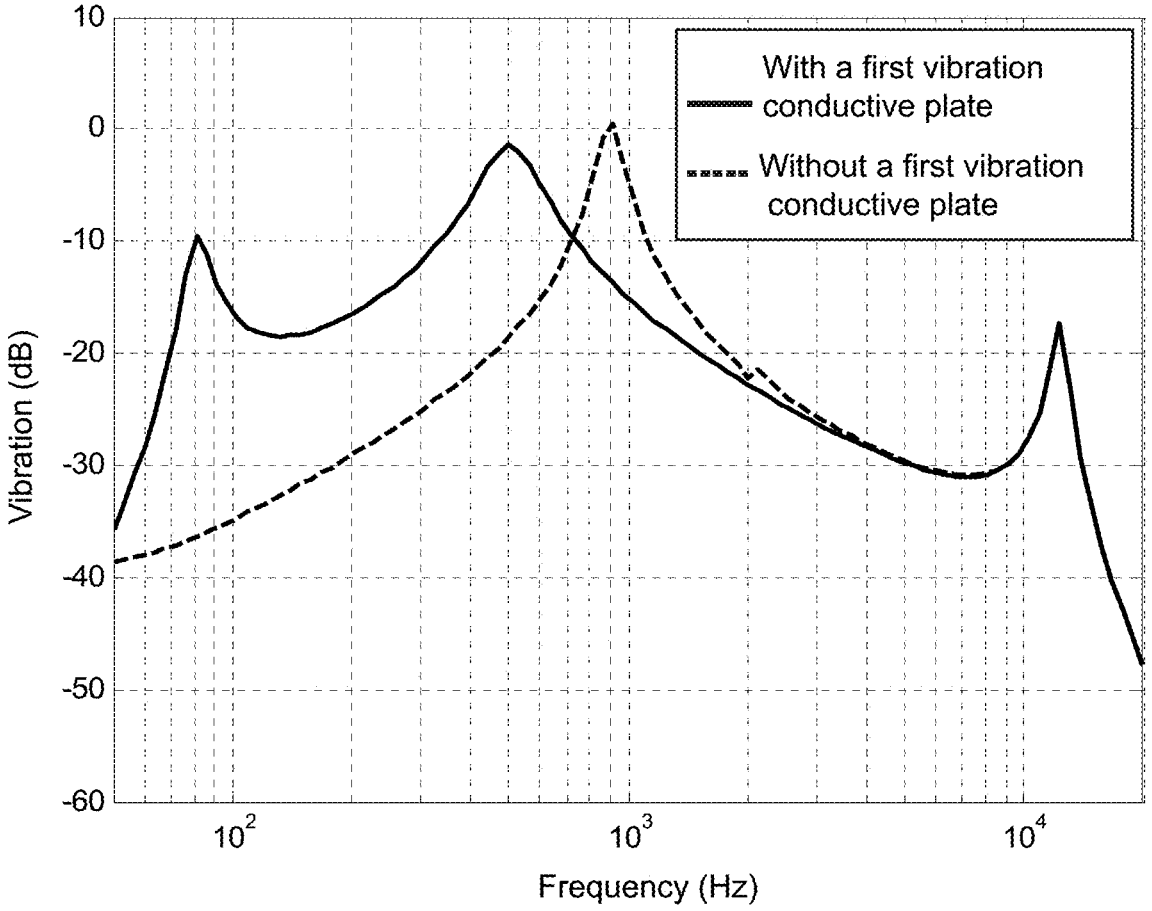
FIG. 8-B

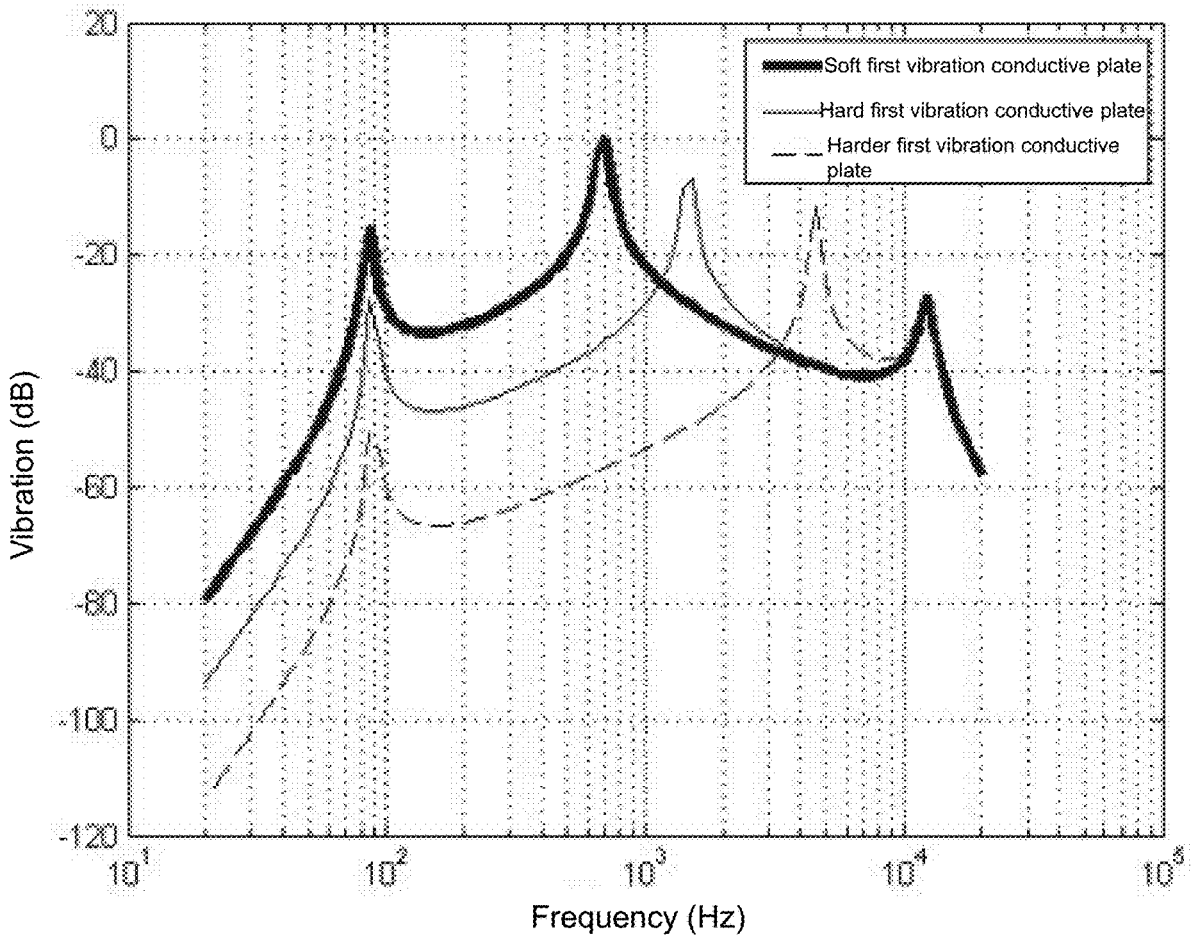
FIG. 8-C

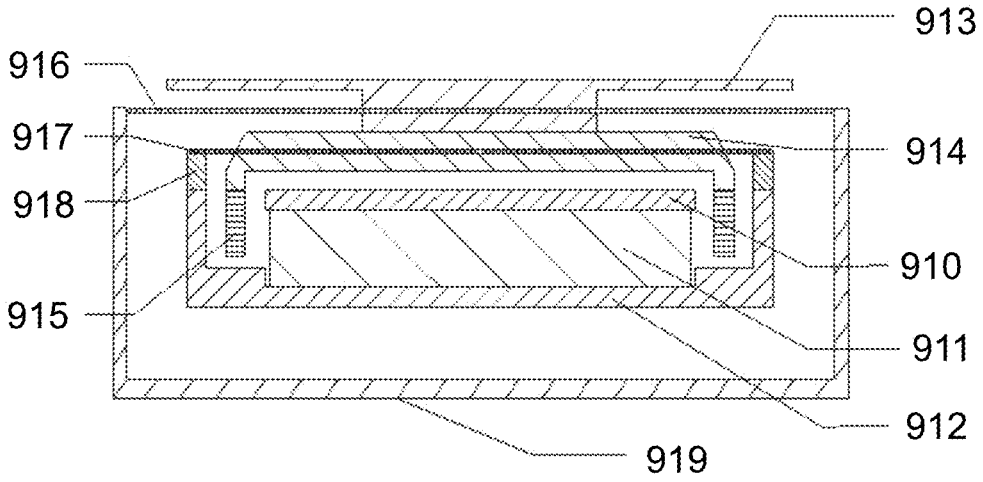
FIG. 9-A

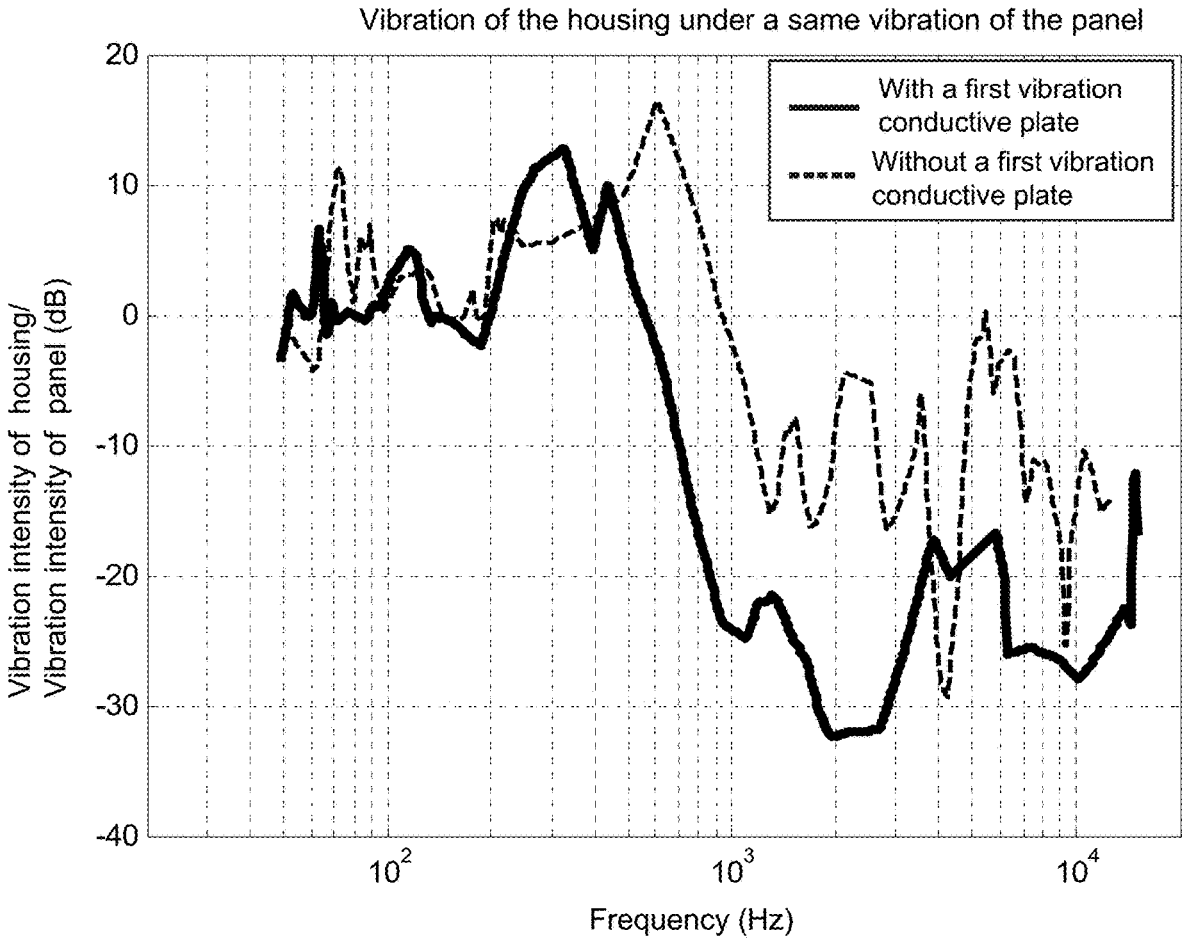
FIG. 9-B

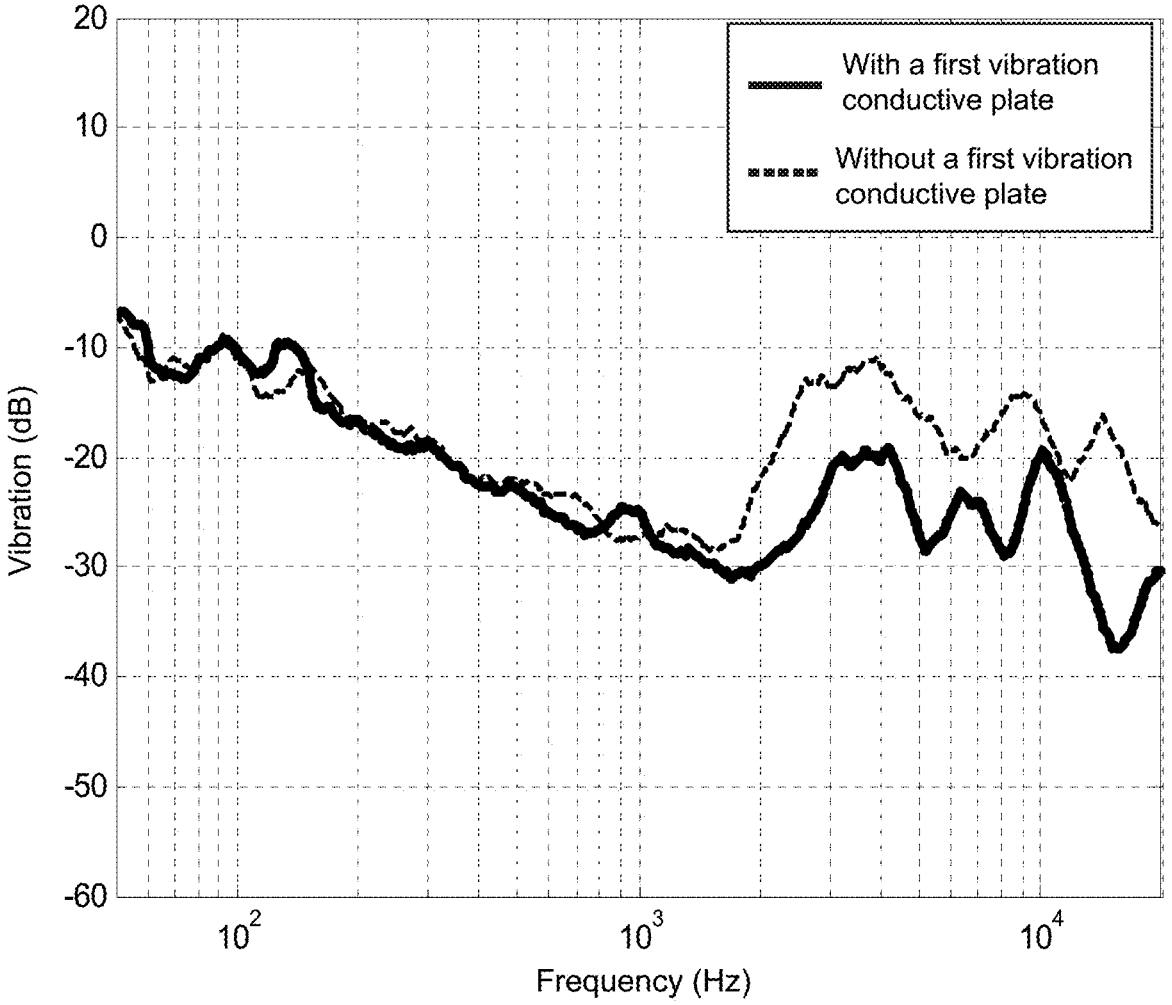
FIG. 9-C

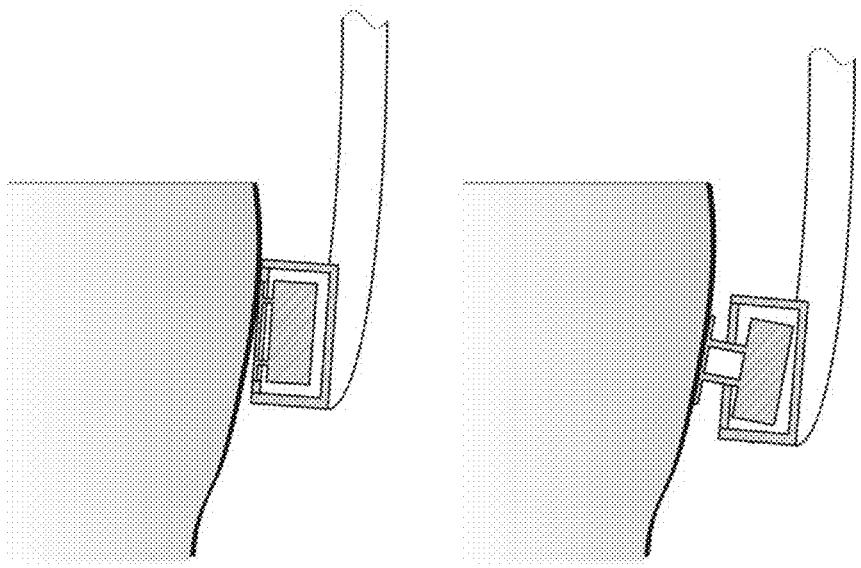
FIG. 11-A

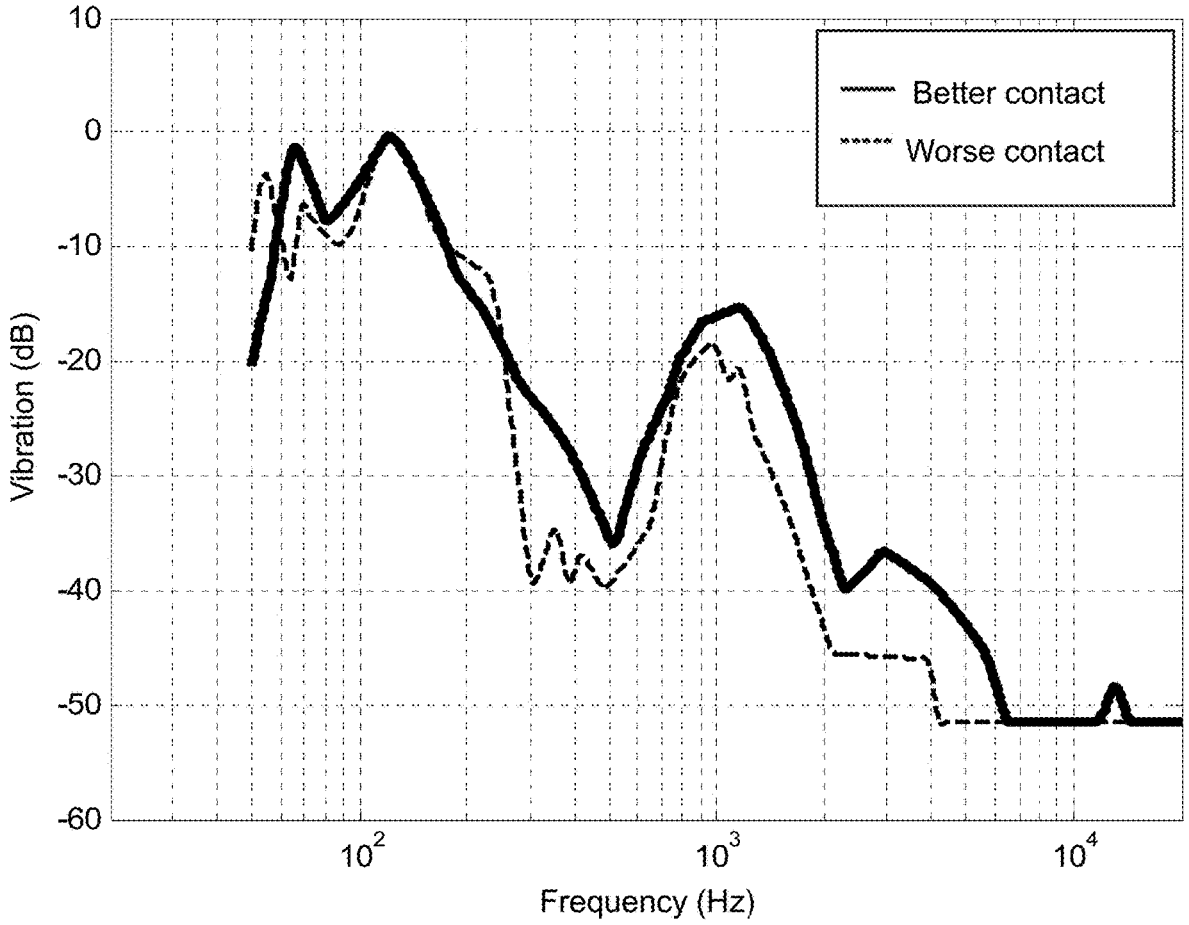
FIG. 11-B

BONE CONDUCTION SPEAKER AND COMPOUND VIBRATION DEVICE THEREOF

CROSS-REFERENCE TO RELATED APPLICATIONS

This application is a continuation-in-part application of U.S. patent application Ser. No. 17/170,817, filed on Feb. 8, 2021, which is a continuation of U.S. patent application Ser. No. 17/161,717, filed on Jan. 29, 2021, which is a continuation-in-part application of U.S. patent application Ser. No. 16/159,070 (issued as U.S. Pat. No. 10,911,876), filed on Oct. 12, 2018, which is a continuation of U.S. patent application Ser. No. 15/197,050 (issued as U.S. Pat. No. 10,117,026), filed on Jun. 29, 2016, which is a continuation of U.S. patent application Ser. No. 14/513,371 (issued as U.S. Pat. No. 9,402,116), filed on Oct. 14, 2014, which is a continuation of U.S. patent application Ser. No. 13/719,754 (issued as U.S. Pat. No. 8,891,792), filed on Dec. 19, 2012, which claims priority to Chinese Patent Application No. 201110438083.9, filed on Dec. 23, 2011; U.S. patent application Ser. No. 17/161,717, filed on Jan. 29, 2021 is also a continuation-in-part application of U.S. patent application Ser. No. 16/833,839, filed on Mar. 30, 2020, which is a continuation of U.S. application Ser. No. 15/752,452 (issued as U.S. Pat. No. 10,609,496), filed on Feb. 13, 2018, which is a national stage entry under 35 U.S.C. § 371 of International Application No. PCT/CN2015/086907, filed on Aug. 13, 2015; this application is also a continuation-in-part of U.S. patent application Ser. No. 17/129,733 filed on Dec. 21, 2020, which is a continuation of International Application No. PCT/CN2020/088482, filed on Apr. 30, 2020, which claims priority to Chinese Patent Application No. 201910888067.6, filed on Sep. 19, 2019, Chinese Patent Application No. 201910888762.2, filed on Sep. 19, 2019, and Chinese Patent Application No. 201910364346.2, filed on Apr. 30, 2019. Each of the above-referenced applications is hereby incorporated by reference.

TECHNICAL FIELD

The present disclosure relates to improvements on a bone conduction speaker and its components, in detail, relates to a bone conduction speaker and its compound vibration device, while the frequency response of the bone conduction speaker has been improved by the compound vibration device, which is composed of vibration boards and vibration conductive plates.

BACKGROUND

Based on the current technology, the principle that we can hear sounds is that the vibration transferred through the air in our external acoustic meatus, reaches to the ear drum, and the vibration in the ear drum drives our auditory nerves, makes us feel the acoustic vibrations. The current bone conduction speakers are transferring vibrations through our skin, subcutaneous tissues and bones to our auditory nerves, making us hear the sounds.

When the current bone conduction speakers are working, with the vibration of the vibration board, the shell body, fixing the vibration board with some fixers, will also vibrate together with it, thus, when the shell body is touching our post auricles, cheeks, forehead or other parts, the vibrations will be transferred through bones, making us hear the sounds clearly.

However, the frequency response curves generated by the bone conduction speakers with current vibration devices are shown as the two solid lines in FIG. 4. In ideal conditions, the frequency response curve of a speaker is expected to be a straight line, and the top plain area of the curve is expected to be wider, thus the quality of the tone will be better, and easier to be perceived by our ears. However, the current bone conduction speakers, with their frequency response curves shown as FIG. 4, have overtopped resonance peaks either in low frequency area or high frequency area, which has limited its tone quality a lot. Thus, it is very hard to improve the tone quality of current bone conduction speakers containing current vibration devices. The current technology needs to be improved and developed.

SUMMARY

The purpose of the present disclosure is providing a bone conduction speaker and its compound vibration device, to improve the vibration parts in current bone conduction speakers, using a compound vibration device composed of a vibration board and a vibration conductive plate to improve the frequency response of the bone conduction speaker, making it flatter, thus providing a wider range of acoustic sound.

The technical proposal of present disclosure is listed as below:

A compound vibration device in bone conduction speaker contains a vibration conductive plate and a vibration board, the vibration conductive plate is set as the first torus, where at least two first rods in it converge to its center. The vibration board is set as the second torus, where at least two second rods in it converge to its center. The vibration conductive plate is fixed with the vibration board. The first torus is fixed on a magnetic system, and the second torus contains a fixed voice coil, which is driven by the magnetic system.

In the compound vibration device, the magnetic system contains a baseboard, and an annular magnet is set on the board, together with another inner magnet, which is concentrically disposed inside this annular magnet, as well as an inner magnetic conductive plate set on the inner magnet, and the annular magnetic conductive plate set on the annular magnet. A grommet is set on the annular magnetic conductive plate to fix the first torus. The voice coil is set between the inner magnetic conductive plate and the annular magnetic plate.

In the compound vibration device, the number of the first rods and the second rods are both set to be three.

In the compound vibration device, the first rods and the second rods are both straight rods.

In the compound vibration device, there is an indentation at the center of the vibration board, which adapts to the vibration conductive plate.

In the compound vibration device, the vibration conductive plate rods are staggered with the vibration board rods.

In the compound vibration device, the staggered angles between rods are set to be 60 degrees.

In the compound vibration device, the vibration conductive plate is made of stainless steel, with a thickness of 0.1-0.2 mm, and, the width of the first rods in the vibration conductive plate is 0.5-1.0 mm; the width of the second rods in the vibration board is 1.6-2.6 mm, with a thickness of 0.8-1.2 mm.

In the compound vibration device, the number of the vibration conductive plate and the vibration board is set to be more than one. They are fixed together through their centers and/or torus.

A bone conduction speaker comprises a compound vibration device which adopts any methods stated above.

The bone conduction speaker and its compound vibration device as mentioned in the present disclosure, adopting the fixed vibration boards and vibration conductive plates, make the technique simpler with a lower cost. Also, because the two parts in the compound vibration device can adjust low frequency and high frequency areas, the achieved frequency response is flatter and wider, the possible problems like abrupt frequency responses or feeble sound caused by single vibration device will be avoided.

BRIEF DESCRIPTION OF THE DRAWINGS

FIG. 8-A illustrates an equivalent vibration model of the vibration portion of the bone conduction speaker according to some embodiments of the present disclosure;

FIG. 8-B illustrates a vibration response curve of the bone conduction speaker according to one specific embodiment of the present disclosure;

FIG. 8-C illustrates a vibration response curve of the bone conduction speaker according to one specific embodiment of the present disclosure;

FIG. 9-A illustrates a structure of the vibration generation portion of the bone conduction speaker according to one specific embodiment of the present disclosure;

FIG. 9-B illustrates a vibration response curve of the bone conduction speaker according to one specific embodiment of the present disclosure;

FIG. 9-C illustrates a sound leakage curve of the bone conduction speaker according to one specific embodiment of the present disclosure;

FIG. 11-A illustrates an application scenario of the bone conduction speaker according to one specific embodiment of the present disclosure;

FIG. 11-B illustrates a vibration response curve of the bone conduction speaker according to one specific embodiment of the present disclosure;

DETAILED DESCRIPTION

A detailed description of the implements of the present disclosure is stated here, together with attached figures.

Figure 1:
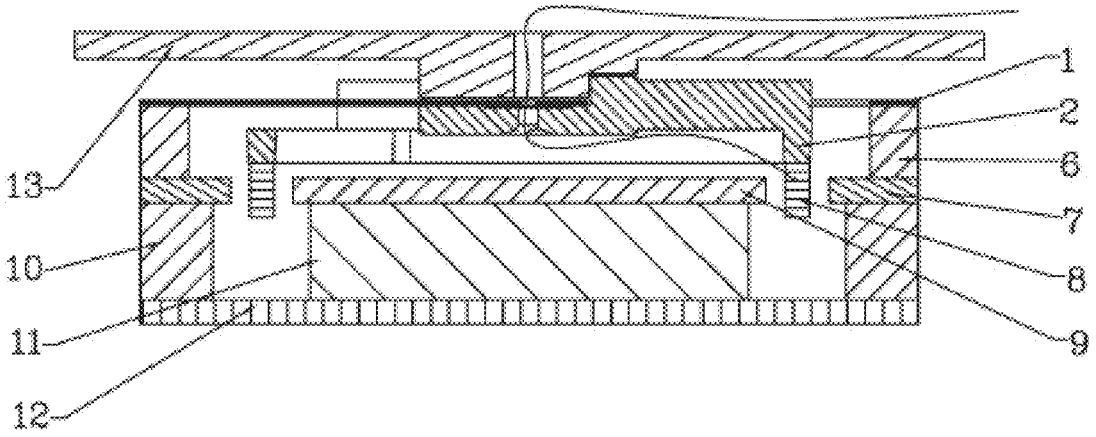
FIG. 1 illustrates a longitudinal section view of the bone conduction speaker in the present disclosure.
Figure 2:
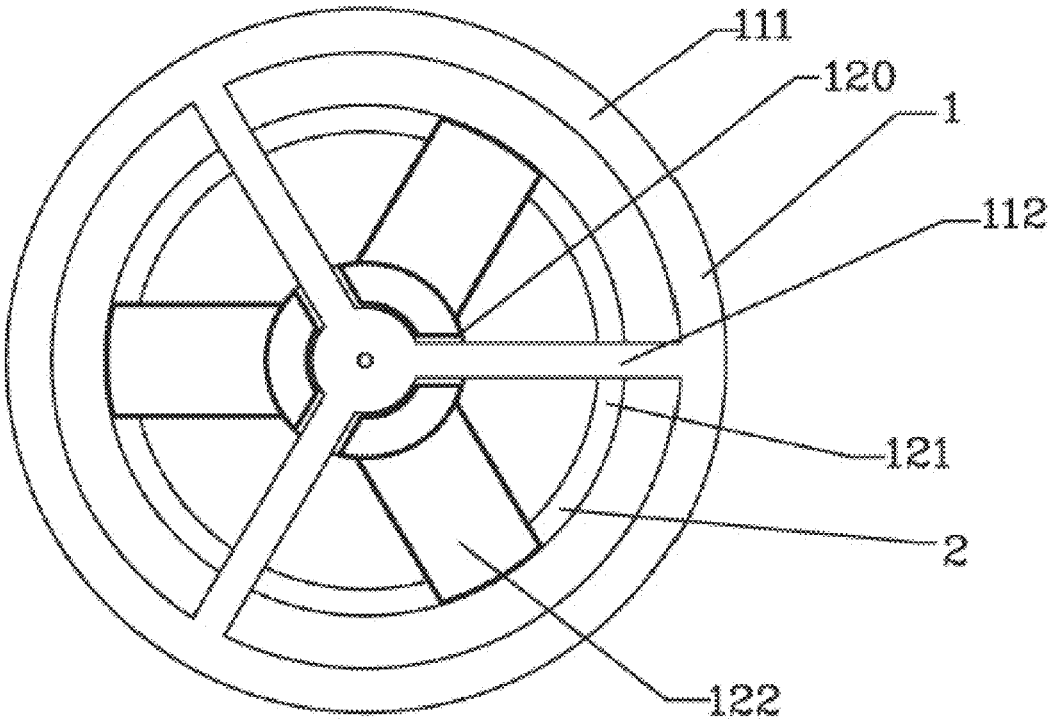
FIG. 2 illustrates a perspective view of the vibration parts in the bone conduction speaker in the present disclosure.
Figure 3:
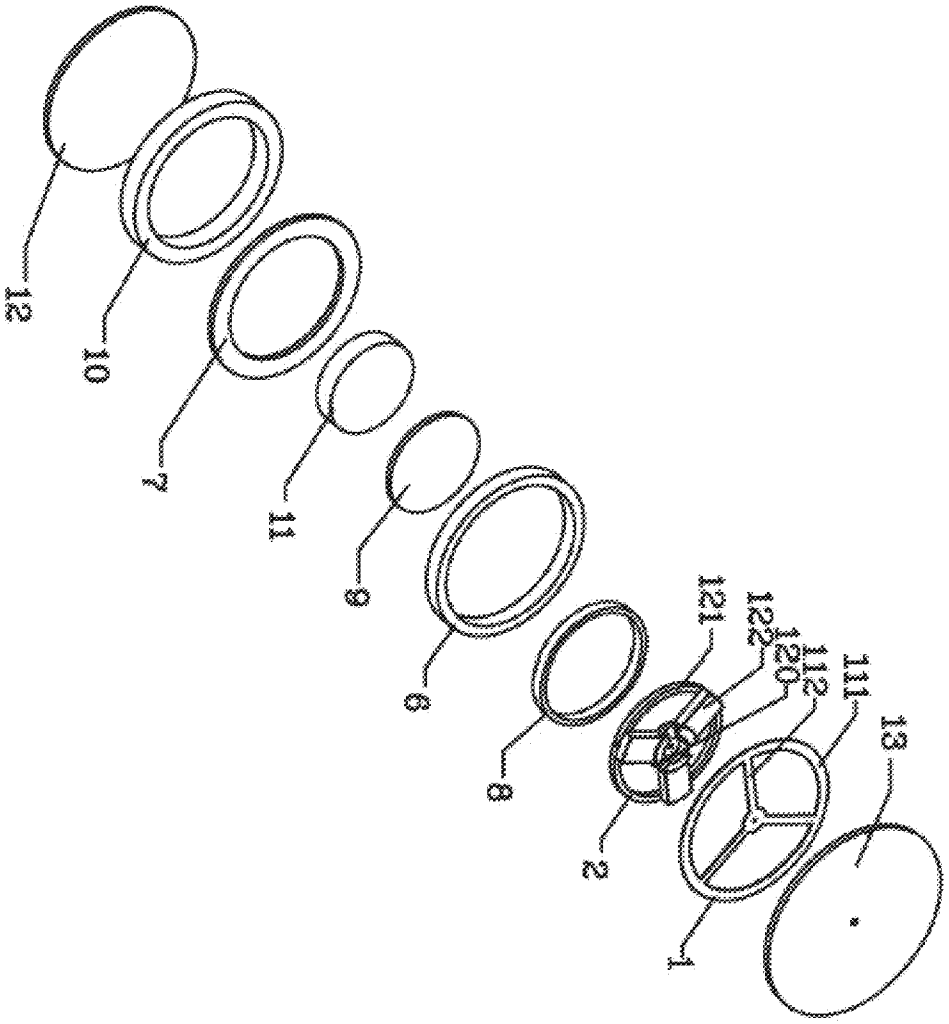
FIG. 3 illustrates an exploded perspective view of the bone conduction speaker in the present disclosure.

As shown in FIG. 1 and FIG. 3, the compound vibration device in the present disclosure of bone conduction speaker, comprises: the compound vibration parts composed of vibration conductive plate 1 and vibration board 2, the vibration conductive plate 1 is set as the first torus 111 and three first rods 112 in the first torus converging to the center of the torus, the converging center is fixed with the center of the vibration board 2. The center of the vibration board 2 is an indentation 120, which matches the converging center and the first rods. The vibration board 2 contains a second torus 121, which has a smaller radius than the vibration conductive plate 1, as well as three second rods 122, which is thicker and wider than the first rods 112. The first rods 112 and the second rods 122 are staggered, present but not limited to an angle of 60 degrees, as shown in FIG. 2. A better solution is, both the first and second rods are all straight rods.

Obviously the number of the first and second rods can be more than two, for example, if there are two rods, they can be set in a symmetrical position; however, the most economic design is working with three rods. Not limited to this rods setting mode, the setting of rods in the present disclosure can also be a spoke structure with four, five or more rods.

The vibration conductive plate 1 is very thin and can be more elastic, which is stuck at the center of the indentation 120 of the vibration board 2. Below the second torus 121 spliced in vibration board 2 is a voice coil 8. The compound vibration device in the present disclosure also comprises a bottom plate 12, where an annular magnet 10 is set, and an inner magnet 11 is set in the annular magnet 10 concentrically. An inner magnet conduction plate 9 is set on the top of the inner magnet 11, while annular magnet conduction plate 7 is set on the annular magnet 10, a grommet 6 is fixed above the annular magnet conduction plate 7, the first torus 111 of the vibration conductive plate 1 is fixed with the grommet 6. The whole compound vibration device is connected to the outside through a panel 13, the panel 13 is fixed with the vibration conductive plate 1 on its converging center, stuck and fixed at the center of both vibration conductive plate 1 and vibration board 2.

It should be noted that, both the vibration conductive plate and the vibration board can be set more than one, fixed with each other through either the center or staggered with both center and edge, forming a multilayer vibration structure, corresponding to different frequency resonance ranges, thus achieve a high tone quality earphone vibration unit with a gamut and full frequency range, despite of the higher cost.

The bone conduction speaker contains a magnet system, composed of the annular magnet conductive plate 7, annular magnet 10, bottom plate 12, inner magnet 11 and inner magnet conductive plate 9, because the changes of audio-frequency current in the voice coil 8 cause changes of magnet field, which makes the voice coil 8 vibrate. The compound vibration device is connected to the magnet system through grommet 6. The bone conduction speaker connects with the outside through the panel 13, being able to transfer vibrations to human bones.

Figure 6:
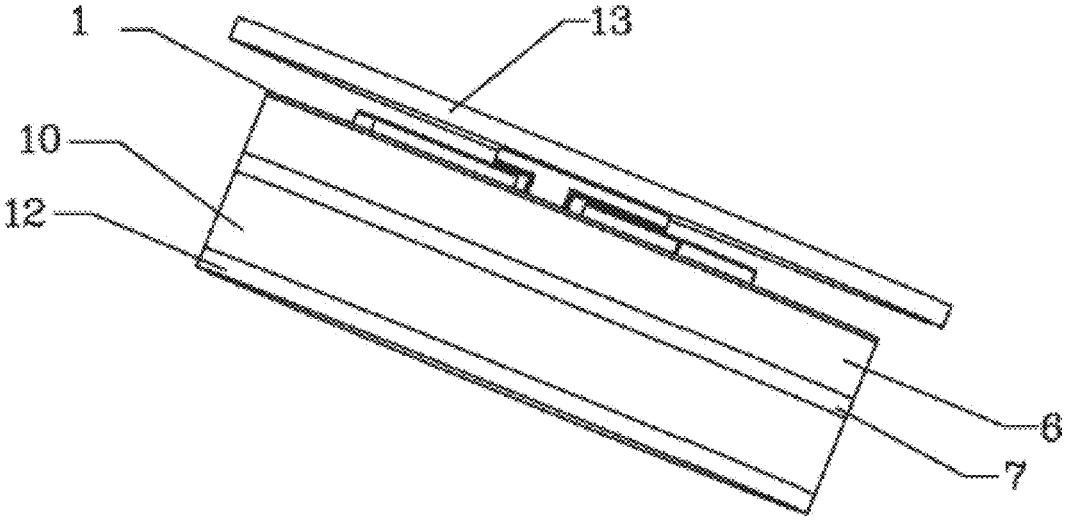
FIG. 6 illustrates a perspective view of the bone conduction speaker in the present disclosure.

In the better implement examples of the present bone conduction speaker and its compound vibration device, the magnet system, composed of the annular magnet conductive plate 7, annular magnet 10, inner magnet conduction plate 9, inner magnet 11 and bottom plate 12, interacts with the voice coil which generates changing magnet field intensity when its current is changing, and inductance changes accordingly, forces the voice coil 8 move longitudinally, then causes the vibration board 2 to vibrate, transfers the vibration to the vibration conductive plate 1, then, through the contact between panel 13 and the post ear, cheeks or forehead of the human beings, transfers the vibrations to human bones, thus generates sounds. A complete product unit is shown in FIG. 6.

Figure 5:
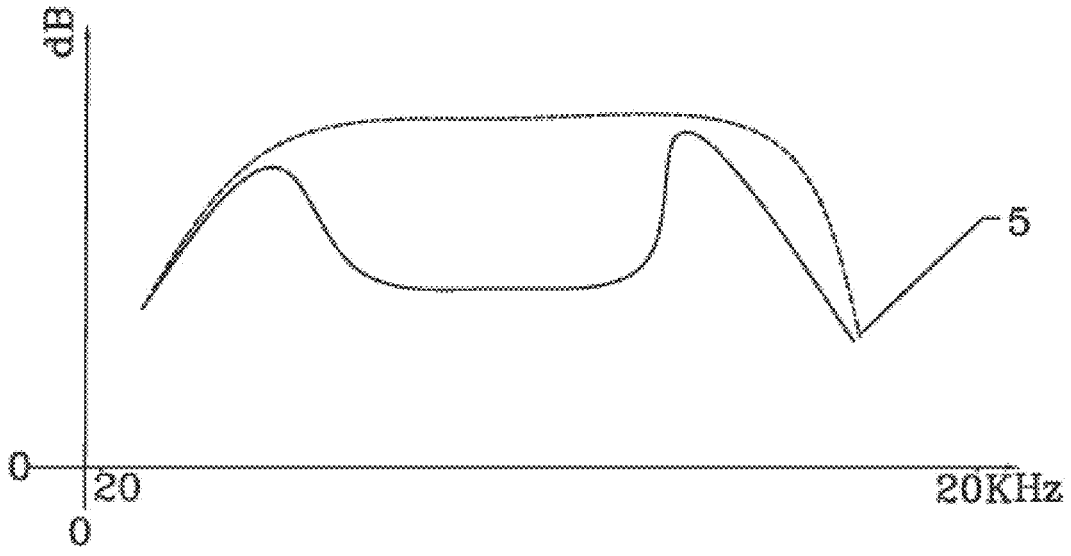
FIG. 5 illustrates a frequency response curves of the bone conduction speakers of the vibration device in the present disclosure.

Through the compound vibration device composed of the vibration board and the vibration conductive plate, a frequency response shown in FIG. 5 is achieved. The double compound vibration generates two resonance peaks, whose positions can be changed by adjusting the parameters including sizes and materials of the two vibration parts, making the resonance peak in low frequency area move to the lower frequency area and the peak in high frequency move higher, finally generates a frequency response curve as the dotted line shown in FIG. 5, which is a flat frequency response curve generated in an ideal condition, whose resonance peaks are among the frequencies catchable with human ears. Thus, the device widens the resonance oscillation ranges, and generates the ideal voices.

In some embodiments, the stiffness of the vibration board may be larger than that of the vibration conductive plate. In some embodiments, the resonance peaks of the frequency response curve may be set within a frequency range perceivable by human ears, or a frequency range that a person's ears may not hear. Preferably, the two resonance peaks may be beyond the frequency range that a person may hear. More preferably, one resonance peak may be within the frequency range perceivable by human ears, and another one may be beyond the frequency range that a person may hear. More preferably, the two resonance peaks may be within the frequency range perceivable by human ears. Further preferably, the two resonance peaks may be within the frequency range perceivable by human ears, and the peak frequency may be in a range of 80 Hz-18000 Hz. Further preferably, the two resonance peaks may be within the frequency range perceivable by human ears, and the peak frequency may be in a range of 200 Hz-15000 Hz. Further preferably, the two resonance peaks may be within the frequency range perceivable by human ears, and the peak frequency may be in a range of 500 Hz-12000 Hz. Further preferably, the two resonance peaks may be within the frequency range perceivable by human ears, and the peak frequency may be in a range of 800 Hz-11000 Hz. There may be a difference between the frequency values of the resonance peaks. For example, the difference between the frequency values of the two resonance peaks may be at least 500 Hz, preferably 1000 Hz, more preferably 2000 Hz, and more preferably 5000 Hz. To achieve a better effect, the two resonance peaks may be within the frequency range perceivable by human ears, and the difference between the frequency values of the two resonance peaks may be at least 500 Hz. Preferably, the two resonance peaks may be within the frequency range perceivable by human ears, and the difference between the frequency values of the two resonance peaks may be at least 1000 Hz. More preferably, the two resonance peaks may be within the frequency range perceivable by human ears, and the difference between the frequency values of the two resonance peaks may be at least 2000 Hz. More preferably, the two resonance peaks may be within the frequency range perceivable by human ears, and the difference between the frequency values of the two resonance peaks may be at least 3000 Hz. Moreover, more preferably, the two resonance peaks may be within the frequency range perceivable by human ears, and the difference between the frequency values of the two resonance peaks may be at least 4000 Hz. One resonance peak may be within the frequency range perceivable by human ears, another one may be beyond the frequency range that a person may hear, and the difference between the frequency values of the two resonance peaks may be at least 500 Hz. Preferably, one resonance peak may be within the frequency range perceivable by human ears, another one may be beyond the frequency range that a person may hear, and the difference between the frequency values of the two resonance peaks may be at least 1000 Hz. More preferably, one resonance peak may be within the frequency range perceivable by human ears, another one may be beyond the frequency range that a person may hear, and the difference between the frequency values of the two resonance peaks may be at least 2000 Hz. More preferably, one resonance peak may be within the frequency range perceivable by human ears, another one may be beyond the frequency range that a person may hear, and the difference between the frequency values of the two resonance peaks may be at least 3000 Hz. Moreover, more preferably, one resonance peak may be within the frequency range perceivable by human ears, another one may be beyond the frequency range that a person may hear, and the difference between the frequency values of the two resonance peaks may be at least 4000 Hz. Both resonance peaks may be within the frequency range of 5 Hz-30000 Hz, and the difference between the frequency values of the two resonance peaks may be at least 400 Hz. Preferably, both resonance peaks may be within the frequency range of 5 Hz-30000 Hz, and the difference between the frequency values of the two resonance peaks may be at least 1000 Hz. More preferably, both resonance peaks may be within the frequency range of 5 Hz-30000 Hz, and the difference between the frequency values of the two resonance peaks may be at least 2000 Hz. More preferably, both resonance peaks may be within the frequency range of 5 Hz-30000 Hz, and the difference between the frequency values of the two resonance peaks may be at least 3000 Hz. Moreover, further preferably, both resonance peaks may be within the frequency range of 5 Hz-30000 Hz, and the difference between the frequency values of the two resonance peaks may be at least 4000 Hz. Both resonance peaks may be within the frequency range of 20 Hz-20000 Hz, and the difference between the frequency values of the two resonance peaks may be at least 400 Hz. Preferably, both resonance peaks may be within the frequency range of 20 Hz-20000 Hz, and the difference between the frequency values of the two resonance peaks may be at least 1000 Hz. More preferably, both resonance peaks may be within the frequency range of 20 Hz-20000 Hz, and the difference between the frequency values of the two resonance peaks may be at least 2000 Hz. More preferably, both resonance peaks may be within the frequency range of 20 Hz-20000 Hz, and the difference between the frequency values of the two resonance peaks may be at least 3000 Hz. And further preferably, both resonance peaks may be within the frequency range of 20 Hz-20000 Hz, and the difference between the frequency values of the two resonance peaks may be at least 4000 Hz. Both the two resonance peaks may be within the frequency range of 100 Hz-18000 Hz, and the difference between the frequency values of the two resonance peaks may be at least 400 Hz. Preferably, both resonance peaks may be within the frequency range of 100 Hz-18000 Hz, and the difference between the frequency values of the two resonance peaks may be at least 1000 Hz. More preferably, both resonance peaks may be within the frequency range of 100 Hz-18000 Hz, and the difference between the frequency values of the two resonance peaks may be at least 2000 Hz. More preferably, both resonance peaks may be within the frequency range of 100 Hz-18000 Hz, and the difference between the frequency values of the two resonance peaks may be at least 3000 Hz. And further preferably, both resonance peaks may be within the frequency range of 100 Hz-18000 Hz, and the difference between the frequency values of the two resonance peaks may be at least 4000 Hz. Both the two resonance peaks may be within the frequency range of 200 Hz-12000 Hz, and the difference between the frequency values of the two resonance peaks may be at least 400 Hz. Preferably, both resonance peaks may be within the frequency range of 200 Hz-12000 Hz, and the difference between the frequency values of the two resonance peaks may be at least 1000 Hz. More preferably, both resonance peaks may be within the frequency range of 200 Hz-12000 Hz, and the difference between the frequency values of the two resonance peaks may be at least 2000 Hz. More preferably, both resonance peaks may be within the frequency range of 200 Hz-12000 Hz, and the difference between the frequency values of the two resonance peaks may be at least 3000 Hz. And further preferably, both resonance peaks may be within the frequency range of 200 Hz-12000 Hz, and the difference between the frequency values of the two resonance peaks may be at least 4000 Hz. Both the two resonance peaks may be within the frequency range of 500 Hz-10000 Hz, and the difference between the frequency values of the two resonance peaks may be at least 400 Hz. Preferably, both resonance peaks may be within the frequency range of 500 Hz-10000 Hz, and the difference between the frequency values of the two resonance peaks may be at least 1000 Hz. More preferably, both resonance peaks may be within the frequency range of 500 Hz-10000 Hz, and the difference between the frequency values of the two resonance peaks may be at least 2000 Hz. More preferably, both resonance peaks may be within the frequency range of 500 Hz-10000 Hz, and the difference between the frequency values of the two resonance peaks may be at least 3000 Hz. And further preferably, both resonance peaks may be within the frequency range of 500 Hz-10000 Hz, and the difference between the frequency values of the two resonance peaks may be at least 4000 Hz. This may broaden the range of the resonance response of the speaker, thus obtaining a more ideal sound quality. It should be noted that in actual applications, there may be multiple vibration conductive plates and vibration boards to form multi-layer vibration structures corresponding to different ranges of frequency response, thus obtaining diatonic, full-ranged and high-quality vibrations of the speaker, or may make the frequency response curve meet requirements in a specific frequency range. For example, to satisfy the requirement of normal hearing, a bone conduction hearing aid may be configured to have a transducer including one or more vibration boards and vibration conductive plates with a resonance frequency in a range of 100 Hz-10000 Hz.

In the better implement examples, but, not limited to these examples, it is adopted that, the vibration conductive plate can be made by stainless steels, with a thickness of 0.1-0.2 mm, and when the middle three rods of the first rods group in the vibration conductive plate have a width of 0.5-1.0 mm, the low frequency resonance oscillation peak of the bone conduction speaker is located between 300 and 900 Hz. And, when the three straight rods in the second rods group have a width between 1.6 and 2.6 mm, and a thickness between 0.8 and 1.2 mm, the high frequency resonance oscillation peak of the bone conduction speaker is between 7500 and 9500 Hz. Also, the structures of the vibration conductive plate and the vibration board is not limited to three straight rods, as long as their structures can make a suitable flexibility to both vibration conductive plate and vibration board, cross-shaped rods and other rod structures are also suitable. Of course, with more compound vibration parts, more resonance oscillation peaks will be achieved, and the fitting curve will be flatter and the sound wider. Thus, in the better implement examples, more than two vibration parts, including the vibration conductive plate and vibration board as well as similar parts, overlapping each other, is also applicable, just needs more costs.

Figure 7:
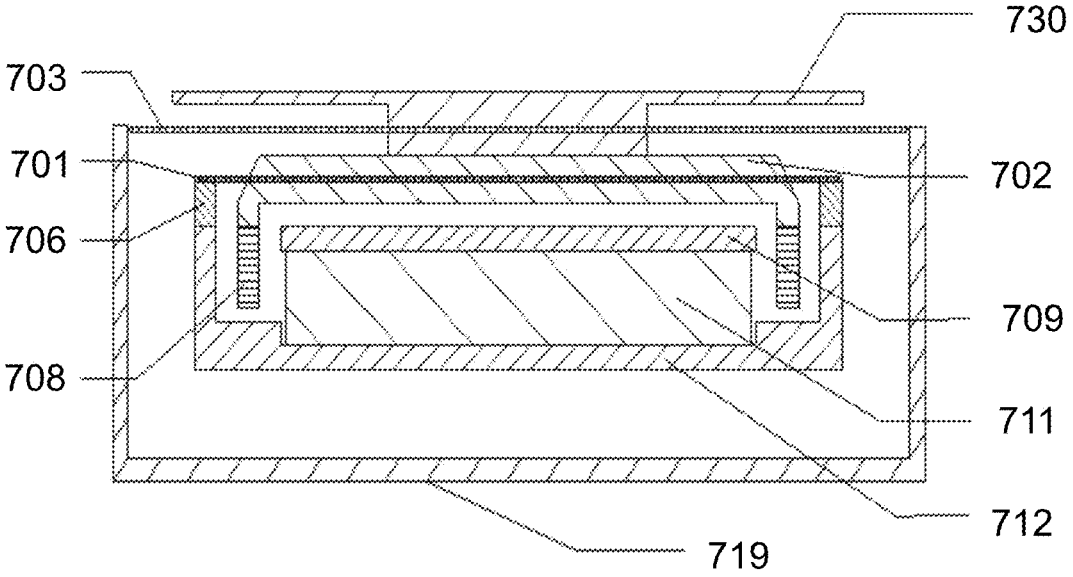
FIG. 7 illustrates a structure of the bone conduction speaker and the compound vibration device according to some embodiments of the present disclosure.

As shown in FIG. 7, in another embodiment, the compound vibration device (also referred to as "compound vibration system") may include a vibration board 702, a first vibration conductive plate 703, and a second vibration conductive plate 701. The first vibration conductive plate 703 may fix the vibration board 702 and the second vibration conductive plate 701 onto a housing 719. The compound vibration system including the vibration board 702, the first vibration conductive plate 703, and the second vibration conductive plate 701 may lead to no less than two resonance peaks and a smoother frequency response curve in the range of the auditory system, thus improving the sound quality of the bone conduction speaker. The equivalent model of the compound vibration system may be shown in FIG. 8-A:

For illustration purposes, 801 represents a housing, 802 represents a panel, 803 represents a voice coil, 804 represents a magnetic circuit system, 805 represents a first vibration conductive plate, 806 represents a second vibration conductive plate, and 807 represents a vibration board. The first vibration conductive plate, the second vibration conductive plate, and the vibration board may be abstracted as components with elasticity and damping; the housing, the panel, the voice coil and the magnetic circuit system may be abstracted as equivalent mass blocks. The vibration equation of the system may be expressed as:

$$m_6x''_6{}'+R_6(x_6-x_5)'+k_6(x_6-x_5)=F, \quad (1)$$

$$x''_7+R_7(x_7-x_5)'+k_7(x_7-x_5)=-F, \quad (2)$$

$$m_5x''_5-R_6(x_6-x_5)'-R_7(x_7-x_5)'+R_8x'_5+k_8x_5-k_6(x_6-x_5)-k_7(x_7-x_5)=0, \quad (3)$$

wherein, F is a driving force, $k_6$ is an equivalent stiffness coefficient of the second vibration conductive plate, $k_7$ is an equivalent stiffness coefficient of the vibration board, $k_8$ is an equivalent stiffness coefficient of the first vibration conductive plate, $R_6$ is an equivalent damping of the second vibration conductive plate, $R_7$ is an equivalent damping of the vibration board, $R_8$ is an equivalent damp of the first vibration conductive plate, $m_5$ is a mass of the panel, $m_6$ is a mass of the magnetic circuit system, $m_7$ is a mass of the voice coil, $x_5$ is a displacement of the panel, $x_6$ is a displacement of the magnetic circuit system, $x_7$ is to displacement of the voice coil, and the amplitude of the panel 802 may be:

$$A_5 = \frac{(-m_6\omega^2(jR_7\omega - k_7) + m_7\omega^2(jR_6\omega - k_6))}{\begin{pmatrix} (-m_5\omega^2 - jR_8\omega + k_8)(-m_6\omega^2 - jR_6\omega + k_6) \\ (-m_7\omega^2 - jR_7\omega + k_7) \\ -m_6\omega^2(-jR_6\omega + k_6)(-m_7\omega^2 - jR_7\omega + k_7) \\ -m_7\omega^2(-jR_7\omega + k_7)(-m_6\omega^2 - jR_6\omega + k_6) \end{pmatrix}} f_0, \quad (4)$$

wherein ω is an angular frequency of the vibration, and $f_0$ is a unit driving force.

The vibration system of the bone conduction speaker may transfer vibrations to a user via a panel (e.g., the panel 730 shown in FIG. 7). According to the equation (4), the vibration efficiency may relate to the stiffness coefficients of the vibration board, the first vibration conductive plate, and the second vibration conductive plate, and the vibration damping. Preferably, the stiffness coefficient of the vibration board $k_7$ may be greater than the second vibration coefficient $k_6$, and the stiffness coefficient of the vibration board $k_7$ may be greater than the first vibration factor $k_8$. The number of resonance peaks generated by the compound vibration system with the first vibration conductive plate may be more than the compound vibration system without the first vibration conductive plate, preferably at least three resonance peaks. More preferably, at least one resonance peak may be beyond the range perceivable by human ears. More preferably, the resonance peaks may be within the range perceivable by human ears. More further preferably, the resonance peaks may be within the range perceivable by human ears, and the frequency peak value may be no more than 18000 Hz. More preferably, the resonance peaks may be within the range perceivable by human ears, and the frequency peak value may be within the frequency range of 100 Hz-15000 Hz. More preferably, the resonance peaks may be within the range perceivable by human ears, and the frequency peak value may be within the frequency range of 200 Hz-12000 Hz. More preferably, the resonance peaks may be within the range perceivable by human ears, and the frequency peak value may be within the frequency range of 500 Hz-11000 Hz. There may be differences between the frequency values of the resonance peaks. For example, there may be at least two resonance peaks with a difference of the frequency values between the two resonance peaks no less than 200 Hz. Preferably, there may be at least two resonance peaks with a difference of the frequency values between the two resonance peaks no less than 500 Hz. More preferably, there may be at least two resonance peaks with a difference of the frequency values between the two resonance peaks no less than 1000 Hz. More preferably, there may be at least two resonance peaks with a difference of the frequency values between the two resonance peaks no less than 2000 Hz. More preferably, there may be at least two resonance peaks with a difference of the frequency values between the two resonance peaks no less than 5000 Hz. To achieve a better effect, all of the resonance peaks may be within the range perceivable by human ears, and there may be at least two resonance peaks with a difference of the frequency values between the two resonance peaks no less than 500 Hz. Preferably, all of the resonance peaks may be within the range perceivable by human ears, and there may be at least two resonance peaks with a difference of the frequency values between the two resonance peaks no less than 1000 Hz. More preferably, all of the resonance peaks may be within the range perceivable by human ears, and there may be at least two resonance peaks with a difference of the frequency values between the two resonance peaks no less than 2000 Hz. More preferably, all of the resonance peaks may be within the range perceivable by human ears, and there may be at least two resonance peaks with a difference of the frequency values between the two resonance peaks no less than 3000 Hz. More preferably, all of the resonance peaks may be within the range perceivable by human ears, and there may be at least two resonance peaks with a difference of the frequency values between the two resonance peaks no less than 4000 Hz. Two of the three resonance peaks may be within the frequency range perceivable by human ears, and another one may be beyond the frequency range that a person may hear, and there may be at least two resonance peaks with a difference of the frequency values between the two resonance peaks no less than 500 Hz. Preferably, two of the three resonance peaks may be within the frequency range perceivable by human ears, and another one may be beyond the frequency range that a person may hear, and there may be at least two resonance peaks with a difference of the frequency values between the two resonance peaks no less than 1000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 2000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 3000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 4000 Hz. One of the three resonance peaks may be within the frequency range perceivable by human ears, and the other two may be beyond the frequency range that a person may hear, and there may be at least two resonance peaks with a difference of the frequency values between the two resonance peaks no less than 500 Hz. Preferably, one of the three resonance peaks may be within the frequency range perceivable by human ears, and the other two may be beyond the frequency range that a person may hear, and there may be at least two resonance peaks with a difference of the frequency values between the two resonance peaks no less than 1000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 2000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 3000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 4000 Hz. All the resonance peaks may be within the frequency range of 5 Hz-30000 Hz, and there may be at least two resonance peaks with a difference of the frequency values between the two resonance peaks of at least 400 Hz. Preferably, all the resonance peaks may be within the frequency range of 5 Hz-30000 Hz, and there may be at least two resonance peaks with a difference of the frequency values between the two resonance peaks of at least 1000 Hz. More preferably, all the resonance peaks may be within the frequency range of 5 Hz-30000 Hz, and there may be at least two resonance peaks with a difference of the frequency values between the two resonance peaks of at least 2000 Hz. More preferably, all the resonance peaks may be within the frequency range of 5 Hz-30000 Hz, and there may be at least two resonance peaks with a difference of the frequency values between the two resonance peaks of at least 3000 Hz. And further preferably, all the resonance peaks may be within the frequency range of 5 Hz-30000 Hz, and there may be at least two resonance peaks with a difference of the frequency values between the two resonance peaks of at least 4000 Hz. All the resonance peaks may be within the frequency range of 20 Hz-20000 Hz, and there may be at least two resonance peaks with a difference of the frequency values between the two resonance peaks of at least 400 Hz. Preferably, all the resonance peaks may be within the frequency range of 20 Hz-20000 Hz, and there may be at least two resonance peaks with a difference of the frequency values between the two resonance peaks of at least 1000 Hz. More preferably, all the resonance peaks may be within the frequency range of 20 Hz-20000 Hz, and there may be at least two resonance peaks with a difference of the frequency values between the two resonance peaks of at least 2000 Hz. More preferably, all the resonance peaks may be within the frequency range of 20 Hz-20000 Hz, and there may be at least two resonance peaks with a difference of the frequency values between the two resonance peaks of at least 3000 Hz. And further preferably, all the resonance peaks may be within the frequency range of 20 Hz-20000 Hz, and there may be at least two resonance peaks with a difference of the frequency values between the two resonance peaks of at least 4000 Hz. All the resonance peaks may be within the frequency range of 100 Hz-18000 Hz, and there may be at least two resonance peaks with a difference of the frequency values between the two resonance peaks of at least 400 Hz. Preferably, all the resonance peaks may be within the frequency range of 100 Hz-18000 Hz, and there may be at least two resonance peaks with a difference of the frequency values between the two resonance peaks of at least 1000 Hz. More preferably, all the resonance peaks may be within the frequency range of 100 Hz-18000 Hz, and there may be at least two resonance peaks with a difference of the frequency values between the two resonance peaks of at least 2000 Hz. More preferably, all the resonance peaks may be within the frequency range of 100 Hz-18000 Hz, and there may be at least two resonance peaks with a difference of the frequency values between the two resonance peaks of at least 3000 Hz. And further preferably, all the resonance peaks may be within the frequency range of 100 Hz-18000 Hz, and there may be at least two resonance peaks with a difference of the frequency values between the two resonance peaks of at least 4000 Hz. All the resonance peaks may be within the frequency range of 200 Hz-12000 Hz, and there may be at least two resonance peaks with a difference of the frequency values between the two resonance peaks of at least 400 Hz. Preferably, all the resonance peaks may be within the frequency range of 200 Hz-12000 Hz, and there may be at least two resonance peaks with a difference of the frequency values between the two resonance peaks of at least 1000 Hz. More preferably, all the resonance peaks may be within the frequency range of 200 Hz-12000 Hz, and there may be at least two resonance peaks with a difference of the frequency values between the two resonance peaks of at least 2000 Hz. More preferably, all the resonance peaks may be within the frequency range of 200 Hz-12000 Hz, and there may be at least two resonance peaks with a difference of the frequency values between the two resonance peaks of at least 3000 Hz. And further preferably, all the resonance peaks may be within the frequency range of 200 Hz-12000 Hz, and there may be at least two resonance peaks with a difference of the frequency values between the two resonance peaks of at least 4000 Hz. All the resonance peaks may be within the frequency range of 500 Hz-10000 Hz, and there may be at least two resonance peaks with a difference of the frequency values between the two resonance peaks of at least 400 Hz. Preferably, all the resonance peaks may be within the frequency range of 500 Hz-10000 Hz, and there may be at least two resonance peaks with a difference of the frequency values between the two resonance peaks of at least 1000 Hz. More preferably, all the resonance peaks may be within the frequency range of 500 Hz-10000 Hz, and there may be at least two resonance peaks with a difference of the frequency values between the two resonance peaks of at least 2000 Hz. More preferably, all the resonance peaks may be within the frequency range of 500 Hz-10000 Hz, and there may be at least two resonance peaks with a difference of the frequency values between the two resonance peaks of at least 3000 Hz. Moreover, further preferably, all the resonance peaks may be within the frequency range of 500 Hz-10000 Hz, and there may be at least two resonance peaks with a difference of the frequency values between the two resonance peaks of at least 4000 Hz. In one embodiment, the compound vibration system including the vibration board, the first vibration conductive plate, and the second vibration conductive plate may generate a frequency response as shown in FIG. 8-B. The compound vibration system with the first vibration conductive plate may generate three obvious resonance peaks, which may improve the sensitivity of the frequency response in the low-frequency range (about 600 Hz), obtain a smoother frequency response, and improve the sound quality.

The resonance peak may be shifted by changing a parameter of the first vibration conductive plate, such as the size and material, so as to obtain an ideal frequency response eventually. For example, the stiffness coefficient of the first vibration conductive plate may be reduced to a designed value, causing the resonance peak to move to a designed low frequency, thus enhancing the sensitivity of the bone conduction speaker in the low frequency, and improving the quality of the sound. As shown in FIG. 8-C, as the stiffness coefficient of the first vibration conductive plate decreases (i.e., the first vibration conductive plate becomes softer), the resonance peak moves to the low frequency region, and the sensitivity of the frequency response of the bone conduction speaker in the low frequency region gets improved. Preferably, the first vibration conductive plate may be an elastic plate, and the elasticity may be determined based on the material, thickness, structure, or the like. The material of the first vibration conductive plate may include but not limited to steel (for example but not limited to, stainless steel, carbon steel, etc.), light alloy (for example but not limited to, aluminum, beryllium copper, magnesium alloy, titanium alloy, etc.), plastic (for example but not limited to, polyethylene, nylon blow molding, plastic, etc.). It may be a single material or a composite material that achieve the same performance. The composite material may include but not limited to reinforced material, such as glass fiber, carbon fiber, boron fiber, graphite fiber, graphene fiber, silicon carbide fiber, aramid fiber, or the like. The composite material may also be other organic and/or inorganic composite materials, such as various types of glass fiber reinforced by unsaturated polyester and epoxy, fiberglass comprising phenolic resin matrix. The thickness of the first vibration conductive plate may be not less than 0.005 mm. Preferably, the thickness may be 0.005 mm-3 mm. More preferably, the thickness may be 0.01 mm-2 mm. More preferably, the thickness may be 0.01 mm-1 mm. Moreover, further preferably, the thickness may be 0.02 mm-0.5 mm. The first vibration conductive plate may have an annular structure, preferably including at least one annular ring, preferably, including at least two annular rings. The annular ring may be a concentric ring or a non-concentric ring and may be connected to each other via at least two rods converging from the outer ring to the center of the inner ring. More preferably, there may be at least one oval ring. More preferably, there may be at least two oval rings. Different oval rings may have different curvatures radiuses, and the oval rings may be connected to each other via rods. Further preferably, there may be at least one square ring. The first vibration conductive plate may also have the shape of a plate. Preferably, a hollow pattern may be configured on the plate. Moreover, more preferably, the area of the hollow pattern may be not less than the area of the non-hollow portion. It should be noted that the above-described material, structure, or thickness may be combined in any manner to obtain different vibration conductive plates. For example, the annular vibration conductive plate may have a different thickness distribution. Preferably, the thickness of the ring may be equal to the thickness of the rod. Further preferably, the thickness of the rod may be larger than the thickness of the ring. Moreover, still, further preferably, the thickness of the inner ring may be larger than the thickness of the outer ring.

When the compound vibration device is applied to the bone conduction speaker, the major applicable area is bone conduction earphones. Thus the bone conduction speaker adopting the structure will be fallen into the protection of the present disclosure.

The bone conduction speaker and its compound vibration device stated in the present disclosure, make the technique simpler with a lower cost. Because the two parts in the compound vibration device can adjust the low frequency as well as the high frequency ranges, as shown in FIG. 5, which makes the achieved frequency response flatter, and voice more broader, avoiding the problem of abrupt frequency response and feeble voices caused by single vibration device, thus broaden the application prospection of bone conduction speaker.

Figure 4:
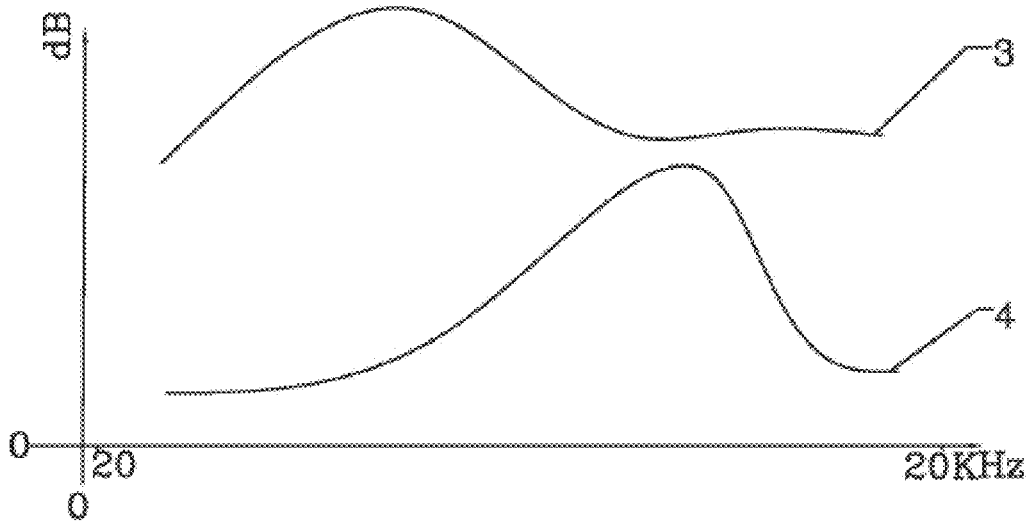
FIG. 4 illustrates a frequency response curves of the bone conduction speakers of vibration device in the prior art.

In the prior art, the vibration parts did not take full account of the effects of every part to the frequency response, thus, although they could have the similar outlooks with the products described in the present disclosure, they will generate an abrupt frequency response, or feeble sound. And due to the improper matching between different parts, the resonance peak could have exceeded the human hearable range, which is between 20 Hz and 20 KHz. Thus, only one sharp resonance peak as shown in FIG. 4 appears, which means a pretty poor tone quality.

It should be made clear that, the above detailed description of the better implement examples should not be considered as the limitations to the present disclosure protections. The extent of the patent protection of the present disclosure should be determined by the terms of claims.

EXAMPLES

Example 1

A bone conduction speaker may include a U-shaped headset bracket/headset lanyard, two vibration units, a transducer connected to each vibration unit. The vibration unit may include a contact surface and a housing. The contact surface may be an outer surface of a silicone rubber transfer layer and may be configured to have a gradient structure including a convex portion. A clamping force between the contact surface and skin due to the headset bracket/headset lanyard may be unevenly distributed on the contact surface. The sound transfer efficiency of the portion of the gradient structure may be different from the portion without the gradient structure.

Example 2

This example may be different from Example 1 in the following aspects. The headset bracket/headset lanyard as described may include a memory alloy. The headset bracket/headset lanyard may match the curves of different users' heads and have a good elasticity and a better wearing comfort. The headset bracket/headset lanyard may recover to its original shape from a deformed status last for a certain period. As used herein, the certain period may refer to ten minutes, thirty minutes, one hour, two hours, five hours, or may also refer to one day, two days, ten days, one month, one year, or a longer period. The clamping force that the headset bracket/headset lanyard provides may keep stable, and may not decline gradually over time. The force intensity between the bone conduction speaker and the body surface of a user may be within an appropriate range, so as to avoid pain or clear vibration sense caused by undue force when the user wears the bone conduction speaker. Moreover, the clamping force of bone conduction speaker may be within a range of 0.2N~1.5N when the bone conduction speaker is used.

Example 3

The difference between this example and the two examples mentioned above may include the following aspects. The elastic coefficient of the headset bracket/headset lanyard may be kept in a specific range, which results in the value of the frequency response curve in low frequency (e.g., under 500 Hz) being higher than the value of the frequency response curve in high frequency (e.g., above 4000 Hz).

Example 4

The difference between Example 4 and Example 1 may include the following aspects. The bone conduction speaker may be mounted on an eyeglass frame, or in a helmet or mask with a special function.

Example 5

The difference between this example and Example 1 may include the following aspects. The vibration unit may include two or more panels, and the different panels or the vibration transfer layers connected to the different panels may have different gradient structures on a contact surface being in contact with a user. For example, one contact surface may have a convex portion, the other one may have a concave structure, or the gradient structures on both the two contact surfaces may be convex portions or concave structures, but there may be at least one difference between the shape or the number of the convex portions.

Example 6

A portable bone conduction hearing aid may include multiple frequency response curves. A user or a tester may choose a proper response curve for hearing compensation according to an actual response curve of the auditory system of a person. In addition, according to an actual requirement, a vibration unit in the bone conduction hearing aid may enable the bone conduction hearing aid to generate an ideal frequency response in a specific frequency range, such as 500 Hz-4000 Hz.

Example 7

A vibration generation portion of a bone conduction speaker may be shown in FIG. 9-A. A transducer of the bone conduction speaker may include a magnetic circuit system including a magnetic flux conduction plate 910, a magnet 911 and a magnetizer 912, a vibration board 914, a coil 915, a first vibration conductive plate 916, and a second vibration conductive plate 917. The panel 913 may protrude out of the housing 919 and may be connected to the vibration board 914 by glue. The transducer may be fixed to the housing 919 via the first vibration conductive plate 916 forming a suspended structure.

A compound vibration system including the vibration board 914, the first vibration conductive plate 916, and the second vibration conductive plate 917 may generate a smoother frequency response curve, so as to improve the sound quality of the bone conduction speaker. The transducer may be fixed to the housing 919 via the first vibration conductive plate 916 to reduce the vibration that the transducer is transferring to the housing, thus effectively decreasing sound leakage caused by the vibration of the housing, and reducing the effect of the vibration of the housing on the sound quality. FIG. 9-B shows frequency response curves of the vibration intensities of the housing of the vibration generation portion and the panel. The bold line refers to the frequency response of the vibration generation portion including the first vibration conductive plate 916, and the thin line refers to the frequency response of the vibration generation portion without the first vibration conductive plate 916. As shown in FIG. 9-B, the vibration intensity of the housing of the bone conduction speaker without the first vibration conductive plate may be larger than that of the bone conduction speaker with the first vibration conductive plate when the frequency is higher than 500 Hz. FIG. 9-C shows a comparison of the sound leakage between a bone conduction speaker includes the first vibration conductive plate 916 and another bone conduction speaker does not include the first vibration conductive plate 916. The sound leakage when the bone conduction speaker includes the first vibration conductive plate may be smaller than the sound leakage when the bone conduction speaker does not include the first vibration conductive plate in the intermediate frequency range (for example, about 1000 Hz). It can be concluded that the use of the first vibration conductive plate between the panel and the housing may effectively reduce the vibration of the housing, thereby reducing the sound leakage.

The first vibration conductive plate may be made of the material, for example but not limited to stainless steel, copper, plastic, polycarbonate, or the like, and the thickness may be in a range of 0.01 mm-1 mm.

Example 8

Figure 10:
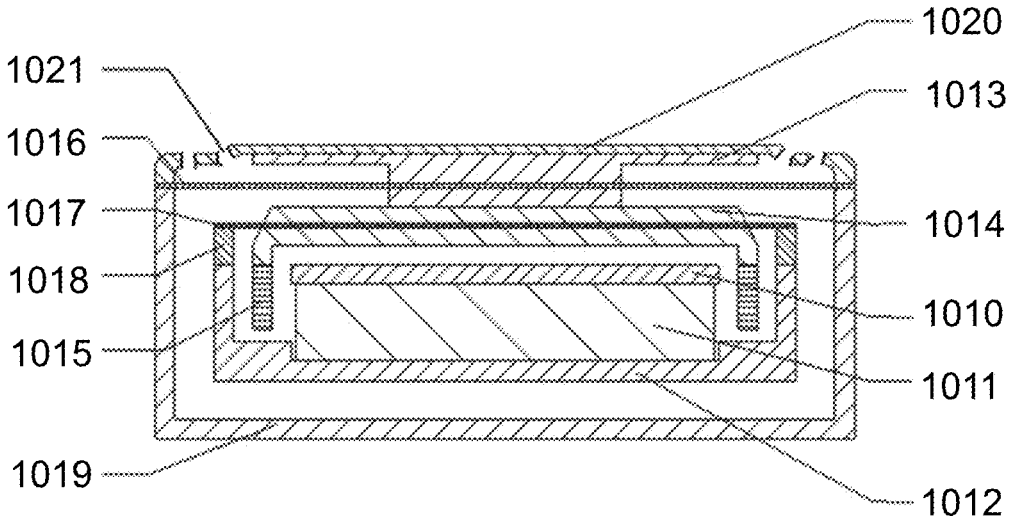
FIG. 10 illustrates a structure of the vibration generation portion of the bone conduction speaker according to one specific embodiment of the present disclosure.

This example may be different with Example 7 in the following aspects. As shown in FIG. 10, the panel 1013 may be configured to have a vibration transfer layer 1020 (for example but not limited to, silicone rubber) to produce a certain deformation to match a user's skin. A contact portion being in contact with the panel 1013 on the vibration transfer layer 1020 may be higher than a portion not being in contact with the panel 1013 on the vibration transfer layer 1020 to form a step structure. The portion not being in contact with the panel 1013 on the vibration transfer layer 1020 may be configured to have one or more holes 1021. The holes on the vibration transfer layer may reduce the sound leakage: the connection between the panel 1013 and the housing 1019 via the vibration transfer layer 1020 may be weakened, and vibration transferred from panel 1013 to the housing 1019 via the vibration transfer layer 1020 may be reduced, thereby reducing the sound leakage caused by the vibration of the housing; the area of the vibration transfer layer 1020 configured to have holes on the portion without protrusion may be reduced, thereby reducing air and sound leakage caused by the vibration of the air; the vibration of air in the housing may be guided out, interfering with the vibration of air caused by the housing 1019, thereby reducing the sound leakage.

Example 9

The difference between this example and Example 7 may include the following aspects. As the panel may protrude out of the housing, meanwhile, the panel may be connected to the housing via the first vibration conductive plate, the degree of coupling between the panel and the housing may be dramatically reduced, and the panel may be in contact with a user with a higher freedom to adapt complex contact surfaces (as shown in the right figure of FIG. 11-A) as the first vibration conductive plate provides a certain amount of deformation. The first vibration conductive plate may incline the panel relative to the housing with a certain angle. Preferably, the slope angle may not exceed 5 degrees.

The vibration efficiency may differ with contacting statuses. A better contacting status may lead to a higher vibration transfer efficiency. As shown in FIG. 11-B, the bold line shows the vibration transfer efficiency with a better contacting status, and the thin line shows a worse contacting status. It may be concluded that the better contacting status may correspond to a higher vibration transfer efficiency.

Example 10

Figure 12:
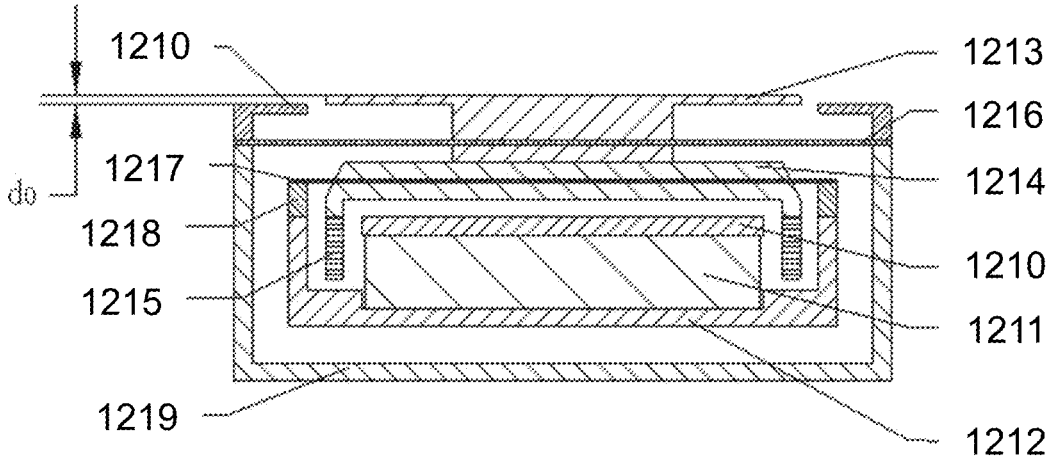
FIG. 12 illustrates a structure of the vibration generation portion of the bone conduction speaker according to one specific embodiment of the present disclosure.

The difference between this example and Example 7 may include the following aspects. A boarder may be added to surround the housing. When the housing contact with a user's skin, the surrounding boarder may facilitate an even distribution of an applied force, and improve the user's wearing comfort. As shown in FIG. 12, there may be a height difference do between the surrounding border 1210 and the panel 1213. The force from the skin to the panel 1213 may decrease the distanced between the panel 1213 and the surrounding border 1210. When the force between the bone conduction speaker and the user is larger than the force applied to the first vibration conductive plate with a deformation of do, the extra force may be transferred to the user's skin via the surrounding border 1210, without influencing the clamping force of the vibration portion, with the consistency of the clamping force improved, thereby ensuring the sound quality.

Example 11

Figure 13:
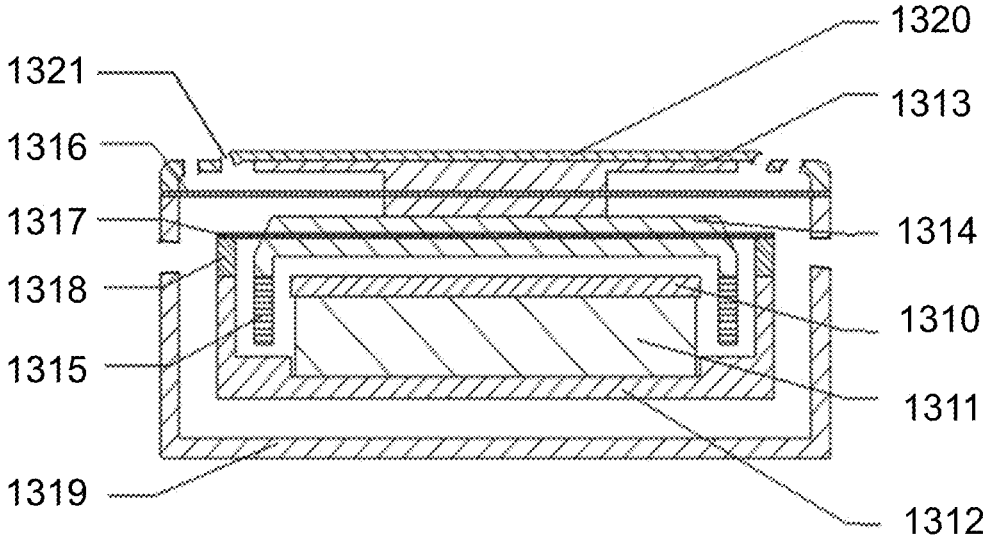
FIG. 13 illustrates a structure of the vibration generation portion of the bone conduction speaker according to one specific embodiment of the present disclosure.

The difference between this example and Example 8 may include the following aspects. As shown in FIG. 13, sound guiding holes are located at the vibration transfer layer 1320 and the housing 1319, respectively. The acoustic wave formed by the vibration of the air in the housing is guided to the outside of the housing, and interferes with the leaked acoustic wave due to the vibration of the air out of the housing, thus reducing the sound leakage.

In some embodiments, the speaker described in the present disclosure may include an earphone (e.g., an open earphone, a headphone, an MP3 player, a hearing aid), or other electronic device with a speaker function. Merely by way of example, a housing of the speaker may have an ear hook type. That is, the housing of the speaker may cooperate with an auricle of the user, and be hung on an ear of the user, such that the speaker may not fall easily. The speaker with the housing of the ear hook type may also be referred to as an ear hook speaker or an ear hook open speaker. As another example, the housing of the speaker may straddle the user's head and be fixed on the head of the user in a manner similar to a headband. Two ends of the housing may be at a distance from the user's ears. The speaker with the housing of the headband type may also be referred to as a headband open earphone. For illustrations, details regarding the speaker may be with reference to an exemplary ear hook speaker in the following description.

Figure 14:
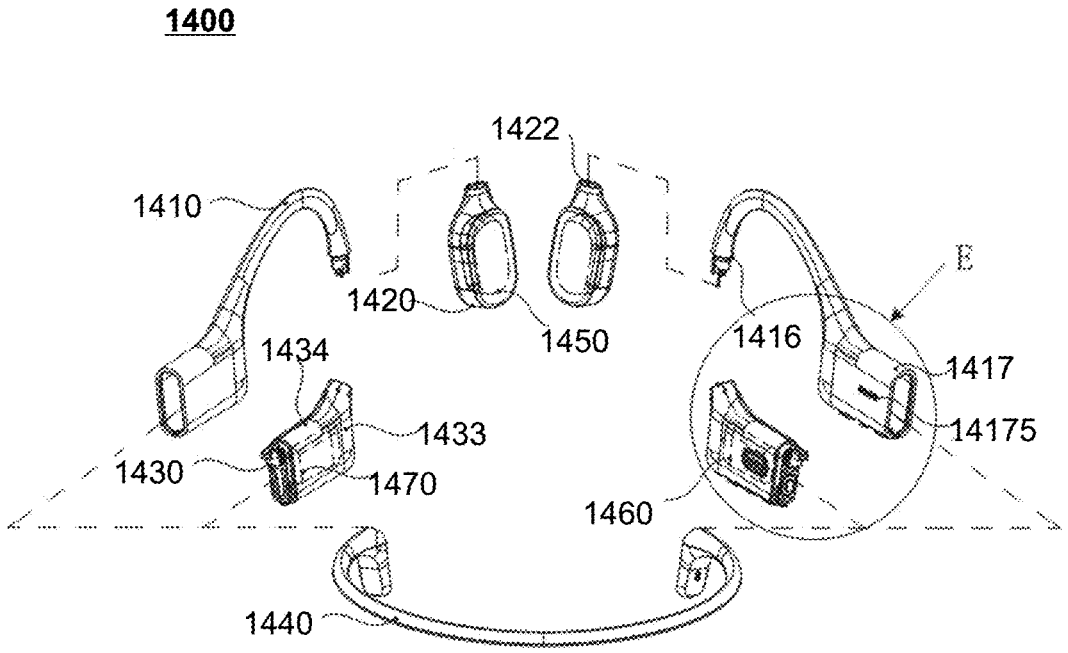
FIG. 14 is a schematic diagram illustrating an exemplary speaker according to some embodiments of the present disclosure.

FIG. 14 is a schematic diagram illustrating an exemplary exploded structure of a speaker according to some embodiments of the present disclosure. As shown in FIG. 14, the structure of the speaker 1400 may be designed such that both ear canals are not blocked, which may also be referred to as a binaural speaker 1400. The speaker 1400 may include primary components such as two ear hooks 1410, two core housings 1420, two circuit housings 1430, a rear hook 1440, two earphone cores (also referred to as vocal structures, or configured as at least a portion of the compound vibration device described elsewhere in the present disclosure) 1450, a control circuit (also referred to as a circuit board) 1460, a battery (also referred to as a power module) 1470, etc. Each of the ear hooks 1410 may include a protective casing 1416 and a housing casing 1417 on which one or more exposed holes 14175 are set. Each of the core housings 1420 may include a socket 1422. Each of the circuit housings 1430 may include two main sidewalls 1433 and two auxiliary sidewalls 1434. A core housing 1420 and a circuit housing 1430 may be disposed at two ends of an ear hook 1410, respectively. Two ends of the rear hook 1440 may be connected to the two circuit housings 1430, respectively. The two core housings 1420 may be used to accommodate the two earphone cores 1450, respectively. Each of the two earphone cores 1450 may include a transducer as described elsewhere in the present disclosure. The two circuit housings 1430 may be used to accommodate the control circuit 1460 and the battery 1470, respectively. When the speaker 1400 is worn, the two ear hooks 1410 may correspond to the left and right ears of the user, respectively. The rear hook 1440 may correspond to the back of the user's head. The speaker 1400 may transmit sound to a human hearing system through a bone conduction or an air conduction to cause the user to generate a hearing. In some embodiments, the speaker 1400 may also include one or more additional components or one or more components shown in FIG. 14 may be omitted. Merely by way of example, the speaker 1400 may include one or more buttons, a Bluetooth module, a microphone, etc.

Figure 15:
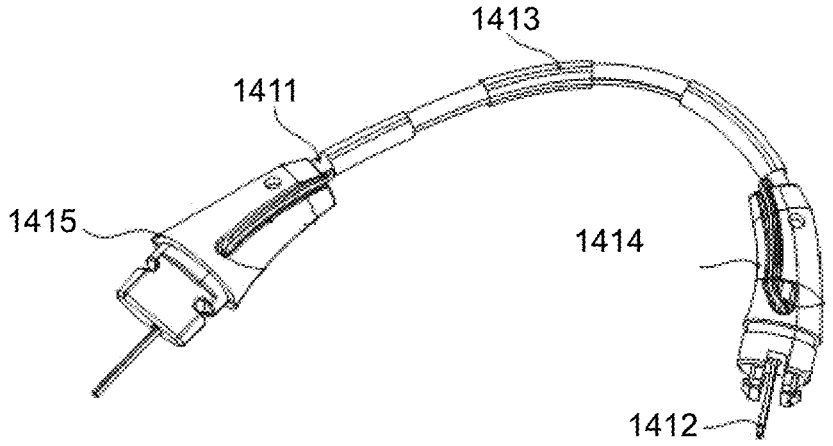
FIG. 15 is a schematic diagram illustrating an exemplary structure of an ear hook of the speaker shown in FIG. 14 according to some embodiments of the present disclosure.
Figure 16:
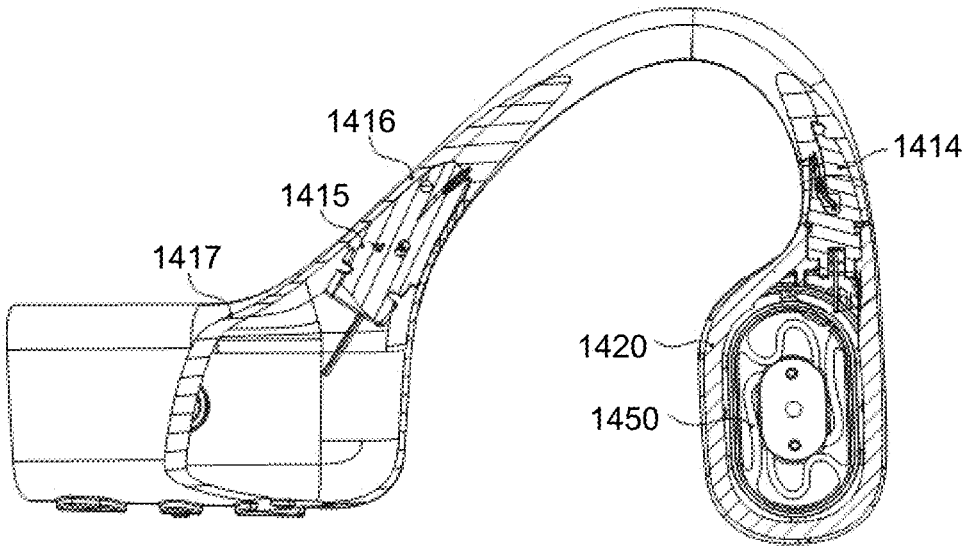
FIG. 16 is a schematic diagram illustrating a partial cross-sectional view of the speaker shown in FIG. 14 according to some embodiments of the present disclosure.

FIG. 15 is a schematic diagram illustrating an exemplary structure of an ear hook of the speaker 1400 according to some embodiments of the present disclosure. FIG. 16 is a schematic diagram illustrating a partial cross-sectional view of the speaker 1400 according to some embodiments of the present disclosure. In some embodiments, as described in connection with FIGS. 14, 15, and 16, the ear hook 1410 may include an elastic metal wire 1411, a lead wire 1412, a fixed casing 1413, and a plug end 1414 and a plug end 1415 disposed at both ends of the elastic metal wire 1411. In some embodiments, the ear hook 1410 may also include a protective casing 1416 and a housing casing 1417 that is integrally formed with the protective casing 1416. The protective casing 1416 may be injection-molded on the periphery of the elastic wire 1411, the wire 1412, the fixed casing 1413, the plug end 1414, and the plug end 1415, such that the protective casing 1416 may be fixedly connected to the elastic metal wire 1411, the wire 1412, the fixed casing 1413, the plug end 1414 and the plug end 1415, respectively. Therefore, it is not necessary to manufacture the protective casing 1416 separately and then to cover the periphery of the elastic wire 1411, the plug end 1414, and the plug end 1415, thereby the manufacturing and assembling process may be simplified, and the protective casing 1416 may be more firmly and stably fixed.

In some embodiments, when the protective casing 1416 is molded, the housing casing 1417 may be integrally molded with the protective casing 1416 on a side near the plug end 1415 simultaneously. In some embodiments, the housing casing 1417 may be integrally molded with the protective casing 1416 into a whole. The circuit housing 1430 may be connected to one end of the ear hook 1410 by fixing with the plug end 1415. A socket 22 of the core housing 1420 may be connected to another end of the ear hook 1410 by fixing with the plug end 1414. The housing casing 1417 may cover the periphery of the circuit housing 1430. In some embodiments, the protective casing 1416 and the housing casing 1417 may be made of a soft material with a certain elasticity, such as soft silicone, rubber, or the like. In some embodiments, the housing casing 1417 may include a bag-shaped structure with one end open, such that the circuit housing 1430 may enter the inside of the housing casing 1417 through the open end of the housing casing 1417. Specifically, the open end of the housing casing 1417 may be an end of the housing casing 1417 departing from the protective casing 1416, such that the circuit housing 1430 may enter the inside of the housing casing 1417 from the end of the housing casing 1417 away from the protective casing 1416 and be covered by the housing casing 1417.

Figure 17:
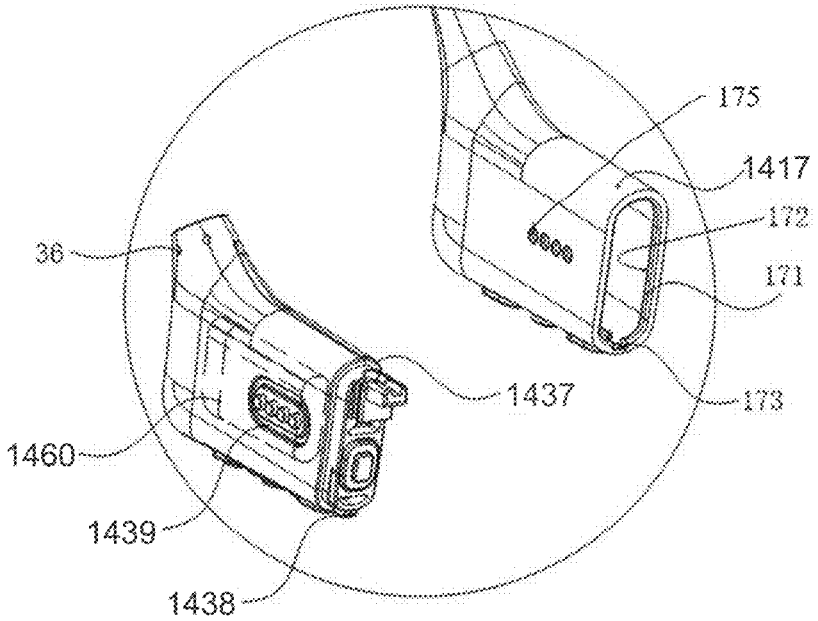
FIG. 17 is a schematic diagram illustrating a partially enlarged view of part E in FIG. 14 according to some embodiments of the present disclosure.

FIG. 17 is a schematic diagram illustrating a partially enlarged view of part E in FIG. 14 according to some embodiments of the present disclosure. In connection with FIGS. 14 and 15, in some embodiments, an annular flange 171 protruding inward may be disposed on the open end of the housing casing 1417. The end of the circuit housing 1430 away from the ear hook 1410 may have a stair shape, thereby forming an annular platform 1437. When the housing casing 1417 covers the periphery of the circuit housing 1430, the annular flange 171 may be in contact with the annular platform 1437. The annular flange 171 may be formed by the inner wall surface of the open end of the housing casing 1417 protruding to a certain thickness toward the inside of the housing casing 1417. The annular flange 171 may include a flange surface 172 facing the ear hook 1410. The annular platform 1437 may be opposite to the flange surface 172 and face a direction of the circuit housing 1430 departing from the ear hook 1410. The height of the flange surface 172 of the annular flange 171 may not be greater than the height of the annular platform 1437, such that when the flange surface 172 of the annular flange 171 is in contact with the annular platform 1437, the inner wall surface of the housing casing 1417 may be in fully contact with the sidewall surface of the circuit housing 1430, such that the housing casing 1417 may tightly cover the periphery of the circuit housing 1430. In some embodiments, a sealant may be applied in a joint region of the annular flange 171 and the annular platform 1437. Specifically, when the housing casing 1417 is coated, a sealant may be pasted on the annular platform 1437 to firmly connect the housing casing 1417 with the circuit housing 1430.

In some embodiments, a positioning block 1438 may be disposed on the circuit housing 1430. The positioning block 1438 may be configured on the annular platform 1437. The positioning block 1438 may extend along a direction of the circuit housing 1430 away from the ear hook 1410. Specifically, the positioning block 1438 may be disposed on an auxiliary sidewall 1434 of the circuit housing 1430. A thickness of the positioning block 1438 protruding on the auxiliary sidewall 1434 may be consistent with the height of the annular platform 1437. One or more positioning blocks 1438 may be set according to requirements. Accordingly, a positioning groove 173 corresponding to the positioning block 1438 may be disposed at the annular flange 171 of the housing casing 1417, such that when the housing casing 1417 covers the periphery of the circuit housing 1430, the positioning groove 173 may cover at least a portion of the positioning block 1438.

Figure 18:
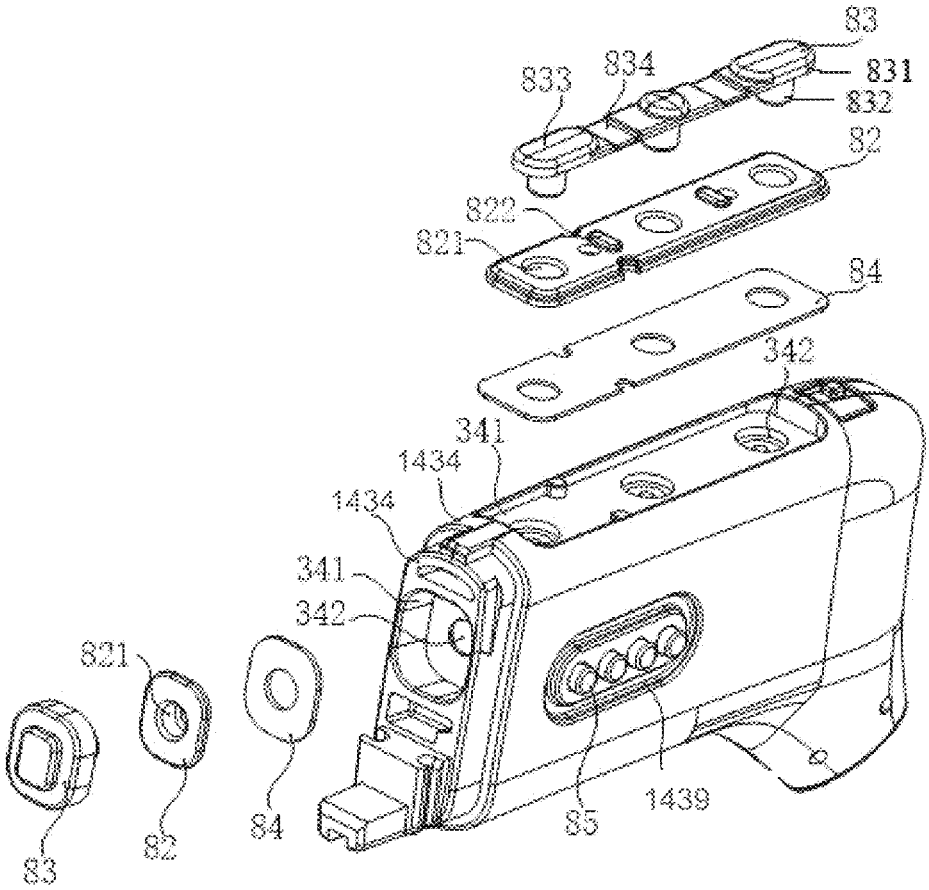
FIG. 18 is a schematic diagram illustrating an exemplary exploded view of a circuit housing and a button structure according to some embodiments of the present disclosure.
Figure 19:
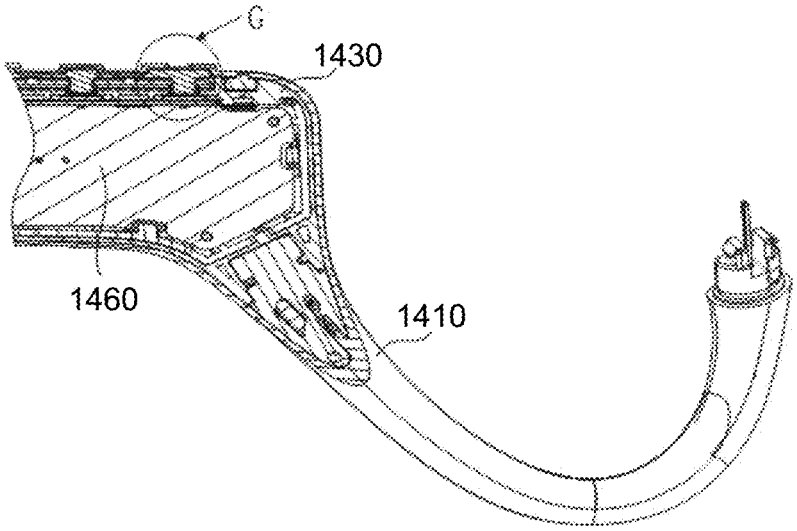
FIG. 19 is a schematic diagram illustrating an exemplary partial cross-sectional view of a circuit housing, a button structure, and an ear hook according to some embodiments of the present disclosure.
Figure 20:
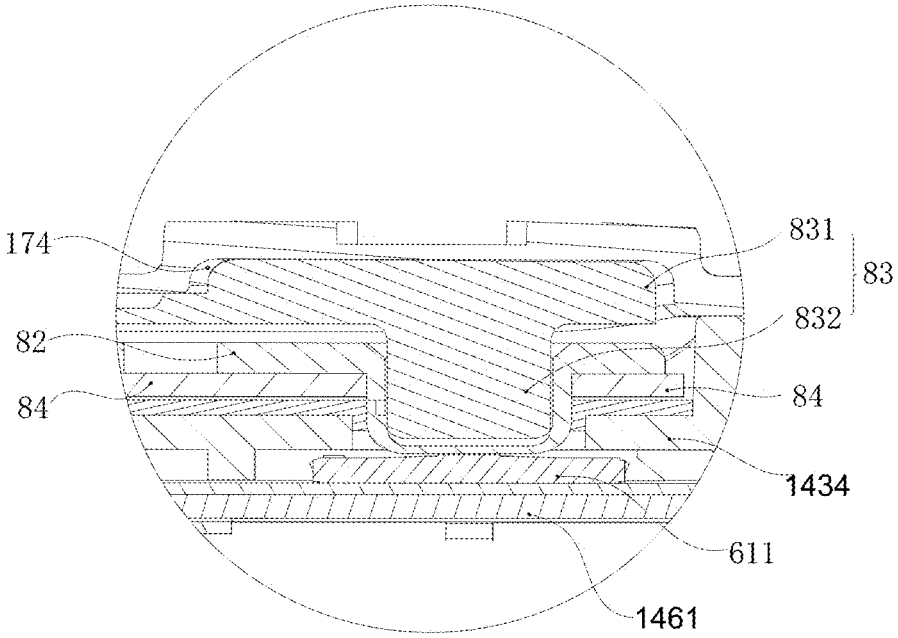
FIG. 20 is schematic diagram illustrating an exemplary partial enlarged view of part G shown in FIG. 19 according to some embodiments of the present disclosure.

FIG. 18 is a schematic diagram illustrating an exemplary exploded view of a circuit housing and a button structure according to some embodiments of the present disclosure. FIG. 19 is a schematic diagram illustrating an exemplary partial cross-sectional view of a circuit housing, a button structure, and an ear hook according to some embodiments of the present disclosure. FIG. 20 is a schematic diagram illustrating an exemplary partial enlarged view of part G shown in FIG. 19 according to some embodiments of the present disclosure. In connection with FIGS. 14, 18, 19, and 20, in some embodiments, a button structure may be disposed on the speaker 1400. In some embodiments, the circuit housing 1430 may have a flat shape. Two sidewalls oppositely configured with relatively large areas of the circuit housing 1430 may be the main sidewalls 1433. Two sidewalls oppositely configured with relatively small areas connected to the two main sidewalls 1433 may be auxiliary sidewalls 1434. A first recessed region 341 may be disposed on the outer surface of an auxiliary sidewall 1434 of the circuit housing 1430. A button hole 342 may be further disposed in the first recessed region 341. The button hole 342 may connect the outer surface and the inner surface of the auxiliary sidewall 1434. The auxiliary sidewalls 1434 of the circuit housing 1430 may include an auxiliary sidewall 1434 facing the back side of a user's head when the user wears the speaker 1400, and may also include an auxiliary sidewall 1434 facing the lower side of the user's head when the user wears the speaker 1400. The number (or count) of the first recessed regions 341 may be one or more. One or more button holes 342 may be disposed in each first recessed region 341 according to actual requirements, which is not specifically limited herein.

In some embodiments, the speaker 1400 may also include an elastic pad 82 and a button 83, and the control circuit 1460 may include a button circuit board 1461. The elastic pad 82 may be disposed on the first recessed region 341. Specifically, the elastic pad 82 may be fixed on the outer surface of an auxiliary sidewall 1434 corresponding to the first recessed region 341 to cover the outside of the button hole 342. Thereby, the elastic pad 82 may be used for sealing and waterproofing, such that external liquid may be prevented from entering the inside of the circuit housing 1430 through the button hole 342. In some embodiments, a second recessed region 821 corresponding to the button hole 342 may be set on the elastic pad 82. The second recessed region 821 may extend to the inside of the button hole 342. In some embodiments, the elastic pad 82 may be made of a soft material, such as a soft silicone or rubber. In addition, the elastic pad 82 may be thin. It may be difficult for the thin elastic pad 82 to be adhered firmly when the thin elastic pad 82 is directly bonded to the outer surface of the auxiliary sidewall 1434. As the elastic pad 82 is disposed between the button 83 and the button hole 342, when the user presses the button, the elastic pad 82 may generate a force opposite to the pressing direction due to the deformation, thereby preventing the button from moving relative to the button hole 342.

In some embodiments, a rigid pad 84 may be disposed between the elastic pad 82 and the circuit housing 1430. The rigid pad 84 and the elastic pad 82 may be closely fixed to each other, specifically, by means of gluing, bonding, injection molding, etc. The rigid pad 84 and the auxiliary sidewall 1434 may further be bonded. Specifically, double-sided adhesive may be used to form an adhesive layer between the rigid pad 84 and the auxiliary sidewall 1434, such that the elastic pad 82 may be firmly fixed on the outer surface of the auxiliary sidewall 1434. In addition, as the elastic pad 82 is soft and thin, it is difficult to maintain a flat state when the user presses the button. By abutting the rigid pad 84, the elastic pad 82 may be kept flat.

In some embodiments, a through hole may be disposed on the rigid pad 84, such that the second recessed region 821 of the elastic pad 82 may further extend to the inside of the button hole 342 through the through hole. In some embodiments, the rigid pad 84 may be made of stainless steel, or other rigid materials (e.g., plastic). The rigid pad 84 may abut the elastic pad 82 by integral molding.

In some embodiments, the button 83 may include a button body 831 and a button contact point 832 protruding on a side of the button body 831. The button body 831 may be disposed on a side of the elastic pad 82 away from the circuit housing 1430, and the button contact point 832 may extend to the inside of the second recessed region 821 and further extend to the button hole 342. As the speaker 1400 in this embodiment is relatively thin and light and the pressing route of the button 83 is short, using a soft button may reduce the user's pressing feeling and bring an unsatisfactory experience, while using the button 83 made of a hard plastic material may bring a well pressing feeling for the user.

The button circuit board 1461 may be disposed inside the circuit housing 1430, and a button switch 611 corresponding to the button hole 342 may be disposed on the button circuit board 1461. Therefore, when the user presses the button 83, the button contact point 832 may contact and trigger the button switch 611 to further implement corresponding function.

In this embodiment, by setting the second recessed region 821 on the elastic pad 82, on one hand, the second recessed region 821 may cover the entire button hole 342, thereby improving the waterproof performance. On the other hand, in the natural state, the button contact point 832 may extend to the inside of the button hole 342 through the second recessed region 821, thereby shortening the button pressing route and reducing the space occupied by the button structure. Therefore, the speaker 1400 may both have a good waterproof performance and occupy less space.

In some embodiments, the button 83 may include one or more button single bodies 833. In an application scenario, the button 83 may include at least two button single bodies 833 disposed away from each other and at least one connecting portion 834 connected to the button single bodies 833. The button single bodies 833 and the connecting portion(s) 834 may be integrally formed. Correspondingly, a button contact point 832 may be disposed on each button single body 833. Each button single body 833 may further correspond to a button hole 342 and a button switch 611. A plurality of button single bodies 833 may be disposed on each of the first recessed regions 341. The user may trigger different button switches 611 by pressing different button single bodies 833 to further realize various functions.

In some embodiments, elastic bumps 822 may be disposed on the elastic pad 82 for supporting the connecting portion 834. As the button 83 includes a plurality of connected button single bodies 833, the setting of the elastic bumps 822 may enable a specific button single body 833 being individually pressed when the user presses the specific button single body 833, thereby avoiding other button single bodies 833 being pressed together due to linkage. In such cases, the corresponding button switch 611 may be triggered accurately. It should be noted that the elastic bump 822 may not be necessary. For example, the elastic bump 822 may be a protruding structure without elasticity, or the protruding structure may not be set according to actual requirements. In some embodiments, a groove 174 corresponding to the button 83 may be disposed on the inner wall of the housing casing 1417, such that the outer periphery of the circuit housing 1430 and the button may be coated.

Figure 21:
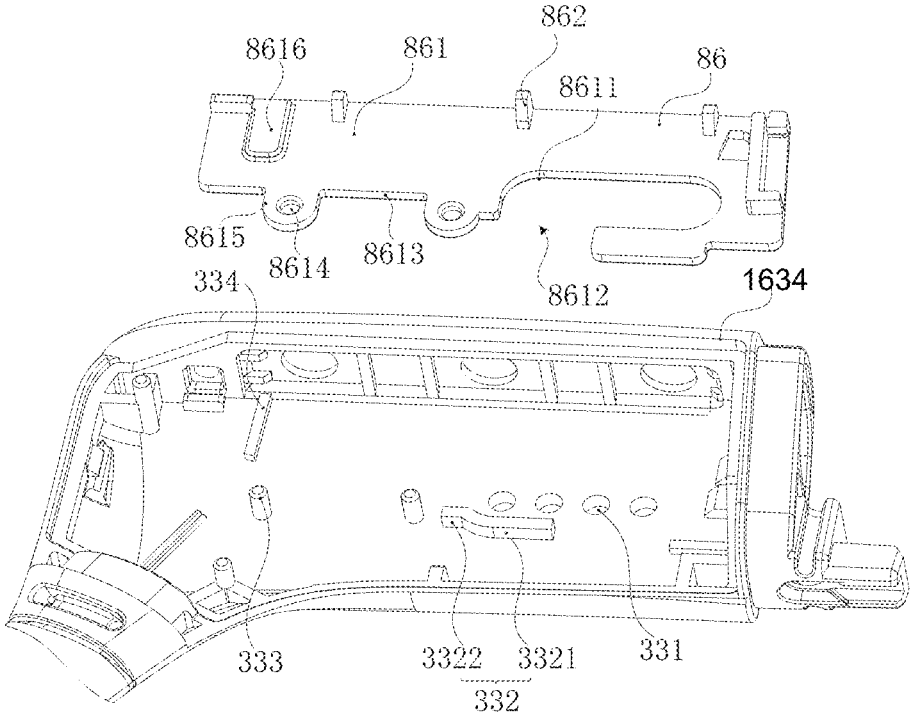
FIG. 21 is a schematic diagram illustrating an exemplary exploded view of a partial structure of a circuit housing and auxiliary piece according to some embodiments of the present disclosure.
Figure 22:
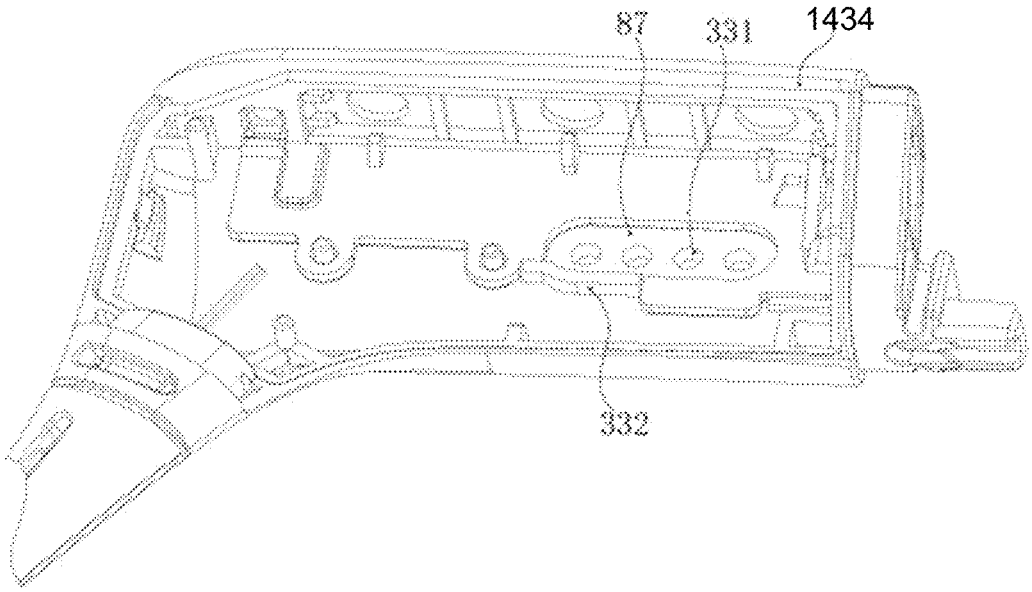
FIG. 22 is schematic diagram illustrating an exemplary partial structure of a circuit housing and an auxiliary piece according to some embodiments of the present disclosure.

FIG. 21 is a schematic diagram illustrating an exemplary exploded view of a partial structure of a circuit housing and auxiliary piece according to some embodiments of the present disclosure. FIG. 22 is schematic diagram illustrating an exemplary partial structure of a circuit housing and an auxiliary piece according to some embodiments of the present disclosure. In connection with FIGS. 14, 21 and 22, in some embodiments, the speaker 1400 may also include the auxiliary piece 86 located inside the circuit housing 1430. The auxiliary piece 86 may include a board 861. A hollowed area 8611 may be disposed on the board 861. The board 861 may be disposed on the inner surface of the main sidewall 1433 by means of hot melting, hot pressing, or bonding, such that a mounting hole 331 disposed on the main sidewall 1433 may be located inside the hollowed area 8611. Specifically, the board surface of the board 861 may abut the inner surface of the main sidewall 1433 in parallel. The auxiliary piece 86 may have a certain thickness. When disposed on the inner surface of the main sidewall 1433, the auxiliary piece 86 with the inner sidewall of the hollowed area 8611 of the auxiliary piece 86 and the main sidewall 1433 may together form a glue groove 87 located at the periphery of the conductive column 85 inserted into the mounting hole 331.

In some embodiments, a sealant may be applied in the glue groove 87 to seal the mounting hole 331 from the inside of the circuit housing 1430 to improve a sealing performance of the circuit housing 1430, thereby improving the waterproof performance of the speaker 1400.

In some embodiments, the material of the auxiliary piece 86 may be the same as that of the circuit housing 1430. The auxiliary piece 86 may be molded separately from the circuit housing 1430. It should be noted that, during the molding stage of the circuit housing 1430, there may often be other structures near the mounting hole 331, such as molding the button hole 342. Molds corresponding to these structures during molding may need to be removed from the inside of the circuit housing 1430. At this time, if the glue groove 87 corresponding to the mounting hole 331 is integrally formed directly inside the circuit housing 1430, the protrusion of the glue groove 87 may interfere with the removal of the molds of these structures, thereby causing inconvenience in production. In this embodiment, the auxiliary piece 86 and the circuit housing 1430 may be separate structures. After the two structures being separately molded, the auxiliary piece 86 may be installed inside the circuit housing 1430 and form the glue groove 87 together with the main sidewall 1433 of the circuit housing 1430, such that during the molding stage of the circuit housing 1430, the molds of part of the structures may not be blocked when removing from the inside of the circuit housing 1430, which causes a smooth progress in production.

In some embodiments, when the circuit housing 1430 is molded, the removal of the molds may only occupy a part of the space of the glue groove 87. A part of the glue groove 87 may be integrally formed on the inner surface of the main sidewall 1433 without affecting the removal of the mold, and the other part of the glue groove 87 may still be formed by the auxiliary piece 86.

In some embodiments, a first strip rib 332 may be integrally formed on the inner surface of the main sidewall 1433, and the location of the first strip rib 332 may not affect the removal of the mold of the circuit housing 1430. A notch 8612 may be disposed in the hollowed area 8611 of the auxiliary piece 86. The first stripe rib 332 may correspond to the notch 8612. After the circuit housing 1430 and the auxiliary piece 86 being respectively formed, the auxiliary piece 86 may be placed on the inner surface of the main sidewall 1433, such that the first strip rib 332 at least partially fits the notch 8612, and then the first strip rib 332 and the auxiliary piece 86 may cooperate to make the glue groove 87 closed.

In this embodiment, as the first strip rib 332 may not block the removal of the molds, the sidewall of the glue groove 87 may be composed of the first strip rib 332 and auxiliary piece 86 which are integrally formed on the inner surface of the main sidewall 1433.

In some embodiments, the first stripe rib 332 may further extend to abut the side edge 8613 of the board 861, thereby positioning the board 861. The first strip rib 332 may include a rib main body 3321 and a positioning arm 3322. The rib main body 3321 may be configured to match and fit the notch 8612 of the hollowed area 8611, thereby forming a sidewall of the glue groove 87. The positioning arm 3322 may be formed by extending from one end of the rib main body 3321 to a side edge 8613 of the board 861 to abut the side edge 8613, thereby positioning the board 861 at the side edge 8613.

In some embodiments, the height of the first strip rib 332 protruding on the inner surface of the main sidewall 1433 may be greater than, less than, or equal to the thickness of the auxiliary piece 86, as long as the first strip rib 332 can form the glue groove 87 together with the auxiliary piece 86 and position the board 861 of the auxiliary piece 86, which is not specifically limited herein.

In some embodiments, a positioning hole 8614 may be disposed on the board 861. The positioning hole 8641 may pass through a motherboard surface of the board 861. A positioning column 333 corresponding to the positioning hole 8614 may be integrally formed on the inner surface of the main sidewall 1433. After the auxiliary piece 86 being disposed on the inner surface of the main sidewall 1433, the positioning column 333 may be inserted into the positioning hole 8614, thereby further positioning the auxiliary piece 86. The numbers (counts) of the positioning holes 8614 and the positioning columns 333 may be the same. In some embodiments, the numbers of the positioning holes 8614 and the positioning columns 333 may both be two.

In an application scenario, at least two lugs 8615 may be formed on the side edge 8613 of the board 861, and two positioning holes 8614 may be respectively disposed on the corresponding lugs 8615. A second strip rib 334 may be integrally formed on the inner surface of the main sidewall 1433. The second strip rib 334 may be extended in a direction toward the auxiliary sidewall 1434, and be perpendicular to an extending direction of the positioning arm 3322 of the first strip rib 332. A positioning groove 8616 with a strip shape corresponding to the second strip rib 334 may be disposed on the board 861. The positioning groove 8616 may be recessed in a direction away from the main sidewall 1433. One end of the positioning groove 8616 may be connected to the side edge 8613 of the board 861 and be perpendicular to the side edge 8613.

In an application scenario, the positioning groove 8616 may be formed only by a recessed surface of the board 861 that is conformed to the main sidewall 1433. The depth of the positioning groove 8616 may be less than the thickness of the board 861. At this time, the surface of the board 861 opposite to the recessed surface may not be affected by the positioning groove 8616. In another application scenario, the depth of the positioning groove 8616 may be greater than the depth of the board 861, such that when a surface of the board 861 near the main sidewall 1433 is recessed, the other opposite surface protrudes toward the recessed direction, thereby cooperating to form the positioning groove 8616. After the auxiliary piece 86 being disposed on the inner surface of the main sidewall 1433, the second strip rib 334 may be embedded in the strip positioning groove 8616 with strip shape to further position the board 861.

In connection with FIG. 14, FIG. 17 and FIG. 18, in some embodiments, an exposed hole 14175 corresponding to the conductive column 85 may be disposed on the housing casing 1417. After the housing casing 1417 being covered around the periphery of the circuit housing 1430, an end of the conductive column 85 located outside the circuit housing 1430 may further be exposed through the exposed hole 14175 to be further connected to external circuits of the speaker 1400, such that the speaker 1400 may be charged or transmit data through the conductive column 85.

In some embodiments, the outer surface of the circuit housing 1430 may be recessed with a glue groove 39 surrounding a plurality of mounting holes 331. Specifically, the shape of the glue groove 39 may be an oval ring, and the plurality of mounting holes 331 may be respectively disposed on the circuit housing 1430 surrounded by the groove 39. A sealant may be applied on the glue groove 39. After the housing casing 1417 and the circuit housing 1430 being assembled, the housing casing 1417 may be in sealed connection with the circuit housing 1430 through the sealant at the peripheries of the mounting holes 331, such that when external liquid enters the inside of the housing casing 1417 through the exposed hole 14175, the housing casing 1417 may slide around the periphery of the circuit housing 1430. In addition, the mounting hole 331 may be further sealed from the outside of the circuit housing 1430 to further improve the sealing performance of the circuit housing 1430, thereby improving the waterproof performance of the speaker 1400.

It should be noted that the above description of the speaker 1400 is merely for illustration purposes, and not intended to limit the scope of the present disclosure. For those skilled in the art, various changes and modifications may be made according to the description of the present disclosure. However, the changes and modifications may not depart from the spirit of the present disclosure. For example, the number (or count) of the first recessed regions 341 may be one or more, and one or more button holes 342 may be set on each of the first recessed regions 341, which is not limited herein. All such modifications are within the scope of the present disclosure.

The embodiments described above are merely implements of the present disclosure, and the descriptions may be specific and detailed, but these descriptions may not limit the present disclosure. It should be noted that those skilled in the art, without deviating from concepts of the bone conduction speaker, may make various modifications and changes to, for example, the sound transfer approaches described in the specification, but these combinations and modifications are still within the scope of the present disclosure.

What is claimed is:

1. A bone conduction speaker, comprising:

a vibration device comprising a vibration conductive plate and a vibration board, wherein the vibration conductive plate is physically connected with the vibration board, vibrations generated by the vibration conductive plate and the vibration board have at least two resonance peaks, frequencies of the at least two resonance peaks being catchable with human ears, and sounds are generated by the vibrations transferred through a human bone; and at least one button disposed on a housing of the bone conduction speaker, wherein each of the at least one button corresponds to a button hole disposed on the housing.

2. The bone conduction speaker according to claim 1, further comprising:

at least one elastic pad corresponding to the at least one button, respectively, wherein each elastic pad prevents the corresponding button from moving relative to the button hole.

3. The bone conduction speaker according to claim 2, further comprising a circuit housing including an accommodating body and a cover, wherein a cavity having an opening at one end of the accommodating body is disposed on the accommodating body, and the cover covers on the opening of the cavity to seal the cavity.

4. The bone conduction speaker according to claim 3, wherein the elastic pad is disposed on a first recessed region, and a second recessed region corresponding to the button hole is set on the elastic pad, the second recesses region extending to an inside of the button hole.

5. The bone conduction speaker according to claim 4, wherein the circuit housing further includes a main sidewall and an auxiliary sidewall connected to the main sidewall, wherein the first recessed region is disposed on an outer surface of the auxiliary side wall.

6. The bone conduction speaker according to claim 5, further comprising:

an auxiliary piece, wherein the auxiliary piece includes a board.

7. The bone conduction speaker according to claim 6, wherein a hollowed region is disposed on the board, and a mounting hole is disposed on the main sidewall and located inside the hollowed region.

8. The bone conduction speaker according to claim 7, further comprising:

a conductive column inserted into the mounting hole, wherein a glue groove is formed at a periphery of the conductive column.

9. The bone conduction speaker according to claim 8, wherein a notch is disposed in the hollowed region of the auxiliary piece, and a first strip rib is integrally formed on an inner surface of the main sidewall corresponding to the notch, wherein the first strip rib and the auxiliary piece cooperate to make the glue groove closed.

10. The bone conduction speaker according to claim 4, wherein the at least one button includes a button body and a button contact point, wherein the button body is disposed on a side of the elastic pad away from the circuit housing, and the button contact point extends to an inside of the second recessed region.

11. The bone conduction speaker according to claim 10, wherein the circuit housing further includes a button circuit board, and a button switch corresponding to the button hole is set on the button circuit board, wherein when the user presses the at least one button, the button contact point contacts and triggers the button switch.

12. The bone conduction speaker according to claim 10, wherein the at least one button includes at least two button single bodies disposed away from each other, and a connecting portion connected to the at least two button single bodies, wherein the button contact point is set on each of the at least two button single bodies, and an elastic bump for supporting the connecting portion is set on the elastic pad.

13. The bone conduction speaker according to claim 4, further comprising a rigid pad disposed between the elastic pad and the circuit housing, wherein a through hole is disposed on the rigid pad, and the second recessed region further extends to the inside of the button hole through the through hole.

14. The bone conduction speaker according to claim 13, wherein the elastic pad and the rigid pad abut each other.

15. The bone conduction speaker according to claim 3, further comprising:

a housing casing covering a periphery of the circuit housing and a periphery of the at least one button.

16. The bone conduction speaker according to claim 15, wherein the housing casing has a bag-shaped structure with one end open, and the circuit housing and the at least one button enter an inside of the housing casing through the open end.

17. The bone conduction speaker according to claim 16, wherein an annular flange protruding inward is disposed on the open end of the housing casing, and an end of the circuit housing has a stair shape and forms an annular platform, wherein when the housing casing covers the periphery of the circuit housing, the annular flange is in contact with the annular platform.

18. The bone conduction speaker according to claim 17, wherein a sealant is applied in a joint region of the annular flange and the annular platform to firmly connect the housing casing with the circuit housing.

19. The vibration device according to claim 1, wherein the vibration conductive plate includes a first torus and at least two first rods, the at least two first rods converging to a center of the first torus.

20. The vibration device according to claim 19, wherein the vibration board includes a second torus and at least two second rods, the at least two second rods converging to a center of the second torus.

* * * * *